US011790771B2

(12) United States Patent
Ogawa

(10) Patent No.: US 11,790,771 B2
(45) Date of Patent: Oct. 17, 2023

(54) VEHICLE-MOUNTED DEVICE FOR CONTROLLING TRANSMISSION OF SENSOR DATA

(71) Applicant: Sumitomo Electric Industries, Ltd., Osaka (JP)

(72) Inventor: Akihiro Ogawa, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 42 days.

(21) Appl. No.: 17/295,442

(22) PCT Filed: Nov. 27, 2019

(86) PCT No.: PCT/JP2019/046406

§ 371 (c)(1),
(2) Date: May 20, 2021

(87) PCT Pub. No.: WO2020/111134

PCT Pub. Date: Jun. 4, 2020

(65) Prior Publication Data

US 2021/0390848 A1 Dec. 16, 2021

(30) Foreign Application Priority Data

Nov. 29, 2018 (JP) ..... 2018-223000

(51) Int. Cl.
*G08G 1/01* (2006.01)

(52) U.S. Cl.
CPC ..... *G08G 1/0112* (2013.01)

(58) Field of Classification Search
CPC ..... G08G 1/0112
See application file for complete search history.

(56) References Cited

U.S. PATENT DOCUMENTS

2015/0318916 A1* 11/2015 Gopal ..... H04B 7/18508 455/13.1

FOREIGN PATENT DOCUMENTS

DE 102017106579 * 3/2017 ..... G08G 1/0112
JP 3619076 B2 * 9/1999

(Continued)

OTHER PUBLICATIONS

International Search Report and Written Opinion dated Mar. 3, 2020, received for PCT Application PCT/JP2019/046406, Filed on Nov. 27, 2019, 10 pages including English Translation.

*Primary Examiner* — Hongmin Fan
(74) *Attorney, Agent, or Firm* — XSENSUS LLP

(57) ABSTRACT

A vehicle-mounted device collects and transmits sensor data to an external apparatus, a buffer unit that stores the sensor data. A determination unit that determines whether or not a predetermined condition is satisfied, and a controller that controls transmission of the sensor data by the transmitter to the external apparatus. The controller causes the transmitter to stop transmitting the sensor data collected by the collector to the external apparatus when the determination unit determines that the predetermined condition is satisfied, and causes, when a determination result obtained by the determination unit changes to indicate that the predetermined condition is not satisfied after the determination unit determines that the predetermined condition is satisfied, the transmitter to concurrently transmit the sensor data stored in the buffer unit to the external apparatus while giving priority to sensor data with a shorter delay time based on priority levels according to delay time.

7 Claims, 17 Drawing Sheets

(56) References Cited

FOREIGN PATENT DOCUMENTS

| | | | | | |
|---|---|---|---|---|---|
| JP | 2003-110749 | A | | 4/2003 | |
| JP | 2006501106 | | * | 10/2003 | ..... G07C 5/008 |
| JP | 2011-76322 | A | | 4/2011 | |
| JP | 2017-28434 | A | | 2/2017 | |
| JP | 6522251 | B1 | | 5/2019 | |
| WO | 2017/051731 | A1 | | 3/2017 | |
| WO | 2018/189913 | A1 | | 10/2018 | |

* cited by examiner

VEHICLE-MOUNTED DEVICE FOR CONTROLLING TRANSMISSION OF SENSOR DATA

CROSS-REFERENCE TO RELATED APPLICATIONS

The present application is based on PCT filing PCT/JP2019/046406, filed Nov. 27, 2019, which claims priority to JP 2018-223000, filed on Nov. 29, 2018, the entire contents of each are incorporated herein by reference.

TECHNICAL FIELD

The present disclosure relates to a system, a server computer, a vehicle-mounted device, a control method, a semiconductor integrated circuit, and a computer program.

BACKGROUND ART

There have been proposed various types of systems (referred to as "driving assistance systems" hereinafter) that assist drivers in driving automobiles and motorcycles (referred to as "vehicles" hereinafter). A driving assistance system collects sensor information from an apparatus (referred to as "infrastructure sensor" hereinafter) equipped with various types of sensor devices (such as a camera and a radar) installed on a road and the vicinity thereof, and analyzes the sensor information so as to provide traffic-related information (such as accidents and traffic congestion) as driving assistance information to a vehicle. As the line speed of mobile communication lines (also referred to as "communication lines" hereinafter) is becoming higher and higher, there has also been proposed a technology in which information is collected from, in addition to the infrastructure sensor, a sensor device installed in the vehicle and is effectively used for driving assistance (i.e., provided as driving assistance information useful for driving). For example, there has been proposed a standard called Cellular V2X from 3GPP (Third Generation Partnership Project) that promotes the standardization of the third generation mobile communication system and a mobile communication system that follows the third generation mobile communication system. V denotes a vehicle, and X denotes something other than a vehicle. This standard is intended to perform communication between a vehicle and something other than a vehicle by using LTE (Long Term Evolution) and 5G (Fifth Generation Mobile Communication System). The line speed of a 5G line can achieve 100 to 1000 times that of an LTE line.

Patent Literature 1 cited below discloses a technology in a system that transmits sensor data from a plurality of sensors to an information processing apparatus via a communication network. In this technology, the system selects a desired communication network in accordance with the situation and transmits the sensor data. Since a wide variety of sensors are used in a sensor network, the sensor data also includes various types of sensor data, such as sensor data with a large volume of information, sensor data with a small volume of information, sensor data that requires real-time-ness of transmission, and sensor data that does not require real-time-ness of transmission. This varies depending on the situation. In order to cope with this, the system selects a communication network based on at least one of a sensor ID (i.e., an ID for identifying each sensor), the sensor type, and the volume of information corresponding to the sensor data to be transmitted, and transmits the sensor data.

CITATION LIST

Patent Literature

PTL 1: Japanese Unexamined Patent Application Publication No. 2003-110749

SUMMARY OF INVENTION

A vehicle-mounted device according to an aspect of the present disclosure is a vehicle-mounted device installed in a vehicle and includes a collector that collects sensor data detected by a sensor with which the vehicle is equipped, a transmitter that transmits the sensor data collected by the collector to an external apparatus, a buffer unit that stores the sensor data collected by the collector, a determination unit that determines whether or not a predetermined condition is satisfied, and a controller that controls transmission of the sensor data by the transmitter to the external apparatus. The controller causes the transmitter to stop transmitting the sensor data collected by the collector to the external apparatus when the determination unit determines that the predetermined condition is satisfied, and causes, when a determination result obtained by the determination unit changes to indicate that the predetermined condition is not satisfied after the determination unit determines that the predetermined condition is satisfied, the transmitter to concurrently transmit the sensor data stored in the buffer unit to the external apparatus while giving priority to sensor data with a shorter delay time based on priority levels according to delay times. The delay times each represent a difference between an acquisition time point of the sensor data and a current time point.

A server computer according to another aspect of the present disclosure includes a receiver that receives the sensor data concurrently transmitted from the aforementioned vehicle-mounted device, and a processor that classifies the sensor data received by the receiver into a plurality of classifications in accordance with the delay times and executes data processing according to each of the plurality of classifications.

A semiconductor integrated circuit according to another aspect of the present disclosure is a semiconductor integrated circuit installed in a vehicle-mounted device that transmits sensor data detected by a sensor, with which a vehicle is equipped, to an external apparatus and includes a buffer unit that stores the sensor data detected by the sensor, a determination unit that determines whether or not a predetermined condition is satisfied, and a controller that controls transmission of the sensor data by the vehicle-mounted device to the external apparatus. The controller causes the vehicle-mounted device to stop transmitting the sensor data detected by the sensor to the external apparatus when the determination unit determines that the predetermined condition is satisfied, and causes, when a determination result obtained by the determination unit changes to indicate that the predetermined condition is not satisfied after the determination unit determines that the predetermined condition is satisfied, the vehicle-mounted device to concurrently transmit the sensor data stored in the buffer unit to the external apparatus while giving priority to sensor data with a shorter delay time based on priority levels according to delay times. The delay times each represent a difference between an acquisition time point of the sensor data and a current time point.

A system according to another aspect of the present disclosure includes a vehicle-mounted device installed in a vehicle, and a server computer that communicates with the vehicle-mounted device. The vehicle-mounted device includes a collector that collects sensor data detected by a sensor with which the vehicle is equipped, a transmitter that transmits the sensor data collected by the collector to the server computer, a buffer unit that stores the sensor data collected by the collector, a determination unit that determines whether or not a predetermined condition is satisfied, and a controller that controls transmission of the sensor data by the transmitter to the server computer. The controller causes the transmitter to stop transmitting the sensor data collected by the collector to the server computer when the determination unit determines that the predetermined condition is satisfied, and causes, when a determination result obtained by the determination unit changes to indicate that the predetermined condition is not satisfied after the determination unit determines that the predetermined condition is satisfied, the transmitter to concurrently transmit the sensor data stored in the buffer unit to the server computer while giving priority to sensor data with a shorter delay time based on priority levels according to delay times. The delay times each represent a difference between an acquisition time point of the sensor data and a current time point. The server computer includes a receiver that receives the sensor data concurrently transmitted from the vehicle-mounted device, and a processor that classifies the sensor data received by the receiver into a plurality of classifications in accordance with the delay times and executes data processing according to each of the plurality of classifications.

A control method according to another aspect of the present disclosure includes a collecting step of collecting sensor data detected by a sensor with which a vehicle is equipped, a transmitting step of transmitting the sensor data collected in the collecting step to an external apparatus, a buffering step of storing the sensor data collected in the collecting step, a determining step of determining whether or not a predetermined condition is satisfied, and a controlling step of controlling transmission of the sensor data in the transmitting step to the external apparatus. The controlling step includes a step of causing the transmitting step to stop transmitting the sensor data collected in the collecting step to the external apparatus when a determination result obtained in the determining step indicates that the predetermined condition is satisfied, and a step of, when the determination result obtained in the determining step indicates that the predetermined condition is satisfied and subsequently changes to indicate that the predetermined condition is not satisfied, concurrently transmitting the sensor data stored in the buffering step to the external apparatus while giving priority to sensor data with a shorter delay time based on priority levels according to delay times. The delay times each represent a difference between an acquisition time point of the sensor data and a current time point.

A computer program according to another aspect of the present disclosure causes a computer installed in a vehicle to realize a collecting function of collecting sensor data detected by a sensor with which the vehicle is equipped, a transmitting function of transmitting the sensor data collected by the collecting function to an external apparatus, a buffering function of storing the sensor data collected by the collecting function, a determining function of determining whether or not a predetermined condition is satisfied, and a controlling function of controlling transmission of the sensor data by the transmitting function to the external apparatus. The controlling function includes a function of causing the transmitting function to stop transmitting the sensor data collected by the collecting function to the external apparatus when the determining function determines that the predetermined condition is satisfied, and a function of, when a determination result obtained by the determining function changes to indicate that the predetermined condition is not satisfied after the determining function determines that the predetermined condition is satisfied, concurrently transmitting the sensor data stored by the buffering function to the external apparatus while giving priority to sensor data with a shorter delay time based on priority levels according to delay times. The delay times each represent a difference between an acquisition time point of the sensor data and a current time point.

A vehicle-mounted device according to a seventh aspect of the present disclosure includes a sensor data collector that collects sensor data output by a sensor with which a vehicle is equipped, a buffer capable of storing the sensor data collected by the sensor data collector, a transmission device that reads the sensor data collected by the sensor data collector or the sensor data stored in the buffer and transmits the sensor data to an external apparatus, and a state controller that controls a state of the vehicle-mounted device related to the sensor data. The state controller causes the state of the vehicle-mounted device to transition between a finite number of states in accordance with the state of the vehicle-mounted device and a throughput of transmission of the sensor data to the external apparatus by the transmission device.

A control method for a vehicle-mounted device according to an eighth aspect of the present disclosure is a control method for a vehicle-mounted device installed in a vehicle and includes a step of causing a sensor data collector that collects sensor data output by a sensor, with which the vehicle is equipped, to collect the sensor data, a step of causing a buffer to store the sensor data collected by the sensor data collector, a step of reading the sensor data collected by the sensor data collector or the sensor data stored in the buffer and transmitting the sensor data to an external apparatus. The control method further includes a step of causing a state controller that controls a state of the vehicle-mounted device related to the sensor data to transition the state of the vehicle-mounted device between a finite number of states in accordance with the state of the vehicle-mounted device and a throughput of transmission of the sensor data to the external apparatus by the transmission device.

A computer program according to a ninth aspect of the present disclosure causes a computer to function as a sensor data collector that collects sensor data output by a sensor with which a vehicle is equipped, a buffer capable of storing the sensor data collected by the sensor data collector, a transmission device that reads the sensor data collected by the sensor data collector or the sensor data stored in the buffer and transmits the sensor data to an external apparatus, and a state controller that causes a state of the vehicle-mounted device related to the sensor data to transition between a finite number of states in accordance with the state of the vehicle-mounted device and a throughput of transmission of the sensor data to the external apparatus by the transmission device.

DESCRIPTION OF EMBODIMENTS

Figure 1:
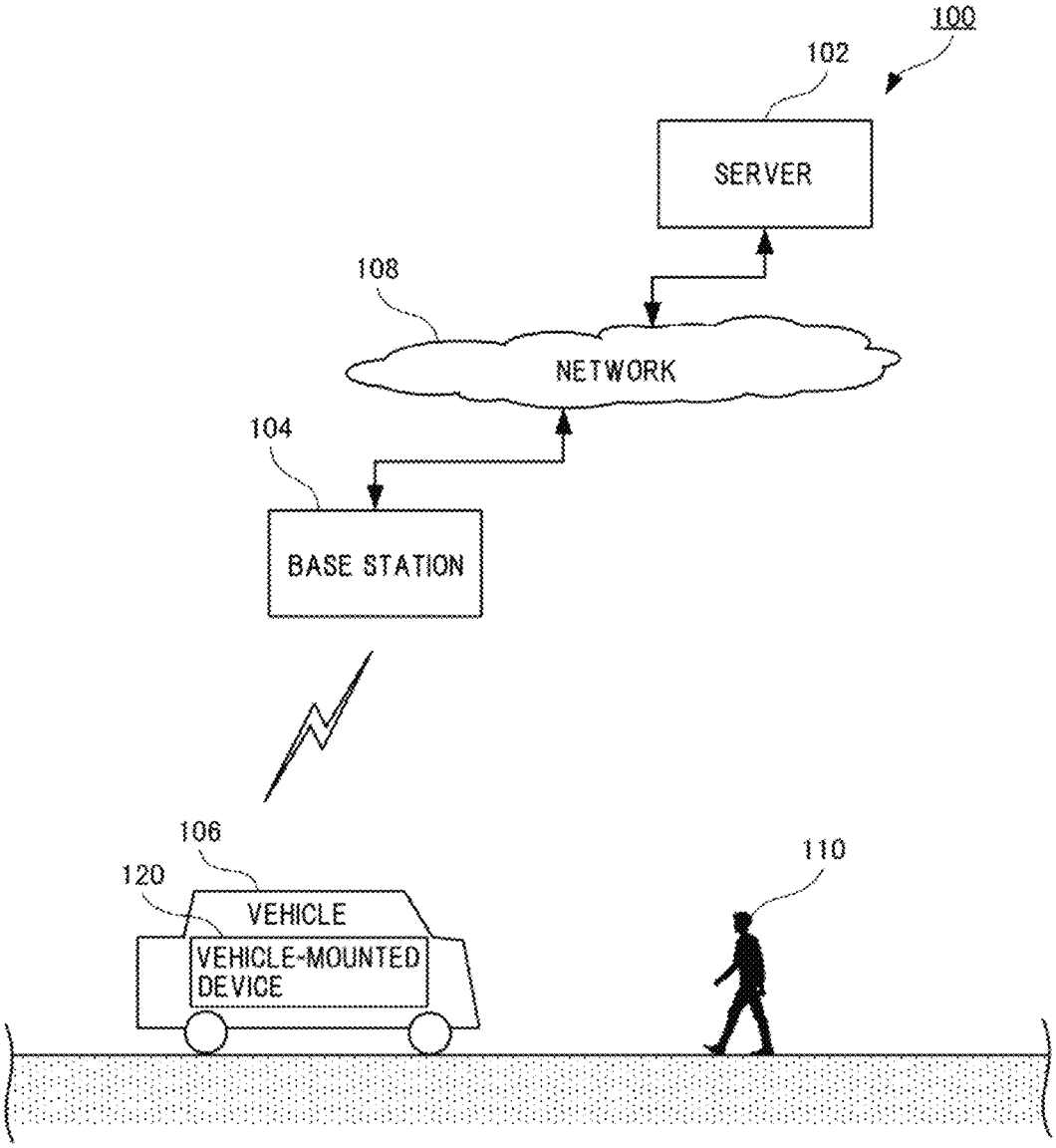
FIG. 1 schematically illustrates the configuration of a driving assistance system according to a first embodiment of the present disclosure.

Problems to be Solved by Present Disclosure

In 5G, the use of a high frequency band with frequencies higher than those in the frequency bands used in existing mobile communication is under review. For example, the use of up to a maximum of 100 GHz is currently being considered. A radio wave in a high frequency band has high spatial-propagation directivity, and decreases significantly in signal strength thereof due to spatial propagation. Therefore, in 5G, the cell size has to be designed to be smaller than before, thus causing the communication radio wave to be intercepted more readily by architectural structures, trees, and moving bodies (such as vehicles and humans). In particular, when sensor data is to be transmitted to, for example, a server from a vehicle-mounted device installed in a vehicle, the communication radio wave is intercepted by an intercepting object, thus frequently causing a situation where communication with a base station is not possible (referred to as "shadowing" hereinafter). For example, when a large-sized vehicle (such as a dump truck or a trailer) is running close to and parallel to the vehicle equipped with the vehicle-mounted device while the vehicle is running, shadowing occurs during the two vehicles running parallel to each other, possibly resulting in a situation where the vehicle-mounted device is not capable of transmitting the sensor data.

When a communication failure occurs due to, for example, shadowing, the failure of normal transmission is detected in accordance with the communication protocol (such as TCP/IP) used, and a process for retransmitting the non-transmitted data is repeated. When the communication becomes possible after the shadowing is resolved, even if the sensor data is successfully transmitted to the server, the server discards the sensor data without using the sensor data unless the sensor data with the long delay time can be used for driving assistance (the long delay time is, for example, the difference between the time point at which the sensor data is acquired by the vehicle-mounted device and the time point at which the sensor data is received by the server). Accordingly, this is problematic in that wasteful retransmission is executed and wasteful sensor data is transmitted. Unless there is an alternative communication network, this problem cannot be solved by the technology disclosed in Patent Literature 1.

Accordingly, an object of the present disclosure is to provide a system, a server computer, a vehicle-mounted device, a control method, a semiconductor integrated circuit, and a computer program that can suppress wasteful retransmission in a situation where a failure occurs in transmission of sensor data from a vehicle-mounted device, and that can transmit effective sensor data to an apparatus that is a transmission destination when the transmission becomes possible.

Advantageous Effects of Present Disclosure

According to the present disclosure, wasteful retransmission can be suppressed in a situation where a failure occurs in transmission of sensor data from a vehicle-mounted device, and effective sensor data can be transmitted to an apparatus that is a transmission destination when the transmission becomes possible.

Description of Embodiments of Present Disclosure

First, embodiments of the present disclosure will be described by listing them below. At least part of the embodiments to be described below may appropriately be combined.

(1) A vehicle-mounted device according to a first aspect of the present disclosure is a vehicle-mounted device installed in a vehicle and includes a collector that collects sensor data detected by a sensor with which the vehicle is equipped, a transmitter that transmits the sensor data collected by the collector to an external apparatus via, for example, a communication line, a buffer unit that stores the sensor data collected by the collector, a determination unit that determines whether or not a predetermined condition is satisfied, and a controller that controls transmission of the sensor data by the transmitter to the external apparatus. The controller causes the transmitter to stop transmitting the sensor data collected by the collector to the external apparatus when the determination unit determines that the predetermined condition is satisfied, and causes, when a determination result obtained by the determination unit changes to indicate that the predetermined condition is not satisfied after the determination unit determines that the predetermined condition is satisfied, the transmitter to concurrently transmit the sensor data stored in the buffer unit to the external apparatus while giving priority to sensor data with a shorter delay time based on priority levels according to delay times. The delay times each represent a difference between an acquisition time point of the sensor data and a current time point. Accordingly, an unnecessary data transmission process can be suppressed, and effective data usable by the external apparatus can be transmitted.

(2) The predetermined condition may include an occurrence of a phenomenon in which communication with the external apparatus is not possible, or may include a state where the vehicle is located within a predetermined range on a road map specified by area information received from the external apparatus and an occurrence of a phenomenon in which communication with the external apparatus is not possible. If the predetermined condition includes the occurrence of the phenomenon, the determination unit may determine that the predetermined condition is satisfied if the phenomenon has occurred, and determine that the predetermined condition is not satisfied if the phenomenon has not occurred. If the predetermined condition includes the state where the vehicle is located within the predetermined range and the occurrence of the phenomenon in which communication with the external apparatus is not possible, the determination unit may determine that the predetermined condition is satisfied if the vehicle is located within the predetermined range and the phenomenon has occurred, and determine that the predetermined condition is not satisfied if the vehicle is located outside the predetermined range or the phenomenon has not occurred. Accordingly, in a situation where there is a communication failure or the vehicle is located within the predetermined range, an unnecessary data transmission process can be suppressed, and effective data usable by the external apparatus can be transmitted when communication becomes possible or when the vehicle exits the predetermined range.

(3) Each delay time may be classified into any one of a plurality of classifications in accordance with length of the delay time, and when the transmitter is to perform the concurrent transmission, the transmitter may transmit the sensor data stored in the buffer unit to the external apparatus while giving priority to sensor data corresponding to the classification including a shorter delay time. Accordingly, information with higher real-time-ness can be transmitted with priority.

(4) The buffer unit may include a plurality of buffers, the plurality of buffers may have a one-to-one correspondence with the plurality of classifications, and a buffer corresponding to a classification including a shorter delay time may have a smaller capacity. Specifically, the buffer unit may include a plurality of buffers for respectively storing sensor data having delay times classified into the plurality of classifications, and capacities of the plurality of buffers may be set such that a buffer corresponding to the classification including the shorter delay time has a smaller capacity. Accordingly, an appropriate buffer capacity can be set in accordance with the real-time-ness.

(5) The vehicle-mounted device may further include a receiver that receives a plurality of permissible delay times from the external apparatus that performs a plurality of processes. Each permissible delay time represents an upper limit for a difference between the acquisition time point of the sensor data to be processed and a time point for executing a corresponding process in the plurality of processes. The buffer unit may include a plurality of buffers, the plurality of buffers may have a one-to-one correspondence with the plurality of classifications, and the capacity of each buffer may be set in accordance with the length of the permissible delay time. Specifically, the buffer unit may include a plurality of buffers individually having capacities set for the plurality of permissible delay times and provided for storing the sensor data to be processed in the plurality of processes. This enables transmission of appropriate data according to a permissible delay time required by a service provided by the external apparatus. The external apparatus to which the vehicle-mounted device is to transmit the sensor data may vary depending on the traveling location of the vehicle-mounted device. Moreover, the permissible delay time required by the service may also vary. Such changes can be appropriately dealt with.

(6) The receiver may further receive a transmission delay time and a processing delay time from the external apparatus The transmission delay time is a time from when the sensor data corresponding to each permissible delay time is transmitted from the vehicle-mounted device to when the sensor data is received by the external apparatus, and the processing delay time is a time spent from when the sensor data corresponding to each permissible delay time starts to undergo the process to when the sensor data has completely undergone the process. The vehicle-mounted device may further include a predictor that predicts a line speed of a communication line when the transmitter concurrently transmits the sensor data, and a changer that changes each of the capacities of the plurality of buffers to a value set in accordance with the line speed predicted by the predictor, the permissible delay time, the transmission delay time, the processing delay time, and a throughput. The throughput is a processing rate from when sensor data corresponding to the respective permissible delay times is read from the plurality of buffers to when the sensor data is transmitted when the transmitter concurrently transmits the sensor data. Accordingly, a non-wasteful, appropriate buffer capacity can be set.

(7) The buffer unit may start storing the sensor data collected by the collector when the determination unit determines that the predetermined condition is satisfied, and may stop storing the sensor data collected by the collector when the determination result obtained by the determination unit changes to indicate that the predetermined condition is not satisfied after the determination unit determines that the predetermined condition is satisfied. Accordingly, a wasteful buffering process can be avoided.

(8) A server computer according to a second aspect of the present disclosure includes a receiver that receives the sensor data concurrently transmitted from the aforementioned vehicle-mounted device, and a processor that classifies the sensor data received by the receiver into a plurality of classifications in accordance with the delay times and executes data processing according to each of the plurality of classifications. Accordingly, the server can receive sensor data suitable for data processing.

(9) A semiconductor integrated circuit according to a third aspect of the present disclosure is a semiconductor integrated circuit installed in a vehicle-mounted device that transmits sensor data detected by a sensor, with which a vehicle is equipped, to an external apparatus and includes a buffer unit that stores the sensor data detected by the sensor, a determination unit that determines whether or not a predetermined condition is satisfied, and a controller that controls transmission of the sensor data by the vehicle-mounted device to the external apparatus. The controller causes the vehicle-mounted device to stop transmitting the sensor data detected by the sensor to the external apparatus when the determination unit determines that the predetermined condition is satisfied, and causes, when a determination result obtained by the determination unit changes to indicate that the predetermined condition is not satisfied after the determination unit determines that the predetermined condition is satisfied, the vehicle-mounted device to concurrently transmit the sensor data stored in the buffer unit to the external apparatus while giving priority to sensor data with a shorter delay time based on priority levels according to delay times. The delay times each represent a difference between an acquisition time point of the sensor data and a current time point. Accordingly, an unnecessary data transmission process can be suppressed, and effective data usable by the external apparatus can be transmitted.

(10) A system according to a fourth aspect of the present disclosure includes a vehicle-mounted device installed in a vehicle, and a server computer that communicates with the vehicle-mounted device. The vehicle-mounted device includes a collector that collects sensor data detected by a sensor with which the vehicle is equipped, a transmitter that transmits the sensor data collected by the collector to the server computer, a buffer unit that stores the sensor data collected by the collector, a determination unit that determines whether or not a predetermined condition is satisfied, and a controller that controls transmission of the sensor data by the transmitter to the server computer. The controller causes the transmitter to stop transmitting the sensor data collected by the collector to the server computer when the determination unit determines that the predetermined condition is satisfied, and causes, when a determination result obtained by the determination unit changes to indicate that the predetermined condition is not satisfied after the determination unit determines that the predetermined condition is satisfied, the transmitter to concurrently transmit the sensor data stored in the buffer unit to the server computer while giving priority to sensor data with a shorter delay time based on priority levels according to delay times. The delay times each represent a difference between an acquisition time point of the sensor data and a current time point. The server computer includes a receiver that receives the sensor data concurrently transmitted from the vehicle-mounted device, and a processor that classifies the sensor data received by the receiver into a plurality of classifications in accordance with the delay times and executes data processing according to each of the plurality of classifications.

(11) A control method according to a fifth aspect of the present disclosure includes a collecting step of collecting sensor data detected by a sensor with which a vehicle is equipped, a transmitting step of transmitting the sensor data collected in the collecting step to an external apparatus, a buffering step of storing the sensor data collected in the collecting step, a determining step of determining whether or not a predetermined condition is satisfied, and a controlling step of controlling transmission of the sensor data in the transmitting step to the external apparatus. The controlling step includes a step of causing the transmitting step to stop transmitting the sensor data collected in the collecting step to the external apparatus when a determination result obtained in the determining step indicates that the predetermined condition is satisfied, and a step of, when the determination result obtained in the determining step indicates that the predetermined condition is satisfied and subsequently changes to indicate that the predetermined condition is not satisfied, concurrently transmitting the sensor data stored in the buffering step to the external apparatus while giving priority to sensor data with a shorter delay time based on priority levels according to delay times. The delay times each represent a difference between an acquisition time point of the sensor data and a current time point. Accordingly, an unnecessary data transmission process can be suppressed, and effective data usable by the external apparatus can be transmitted.

(12) A computer program according to a sixth aspect of the present disclosure causes a computer installed in a vehicle to realize a collecting function of collecting sensor data detected by a sensor with which the vehicle is equipped, a transmitting function of transmitting the sensor data collected by the collecting function to an external apparatus, a buffering function of storing the sensor data collected by the collecting function, a determining function of determining whether or not a predetermined condition is satisfied, and a controlling function of controlling transmission of the sensor data by the transmitting function to the external apparatus. The controlling function includes a function of causing the transmitting function to stop transmitting the sensor data collected by the collecting function to the external apparatus when the determining function determines that the predetermined condition is satisfied, and a function of, when a determination result obtained by the determining function changes to indicate that the predetermined condition is not satisfied after the determining function determines that the predetermined condition is satisfied, concurrently transmitting the sensor data stored by the buffering function to the external apparatus while giving priority to sensor data with a shorter delay time based on priority levels according to delay times. The delay times each represent a difference between an acquisition time point of the sensor data and a current time point. Accordingly, an unnecessary data transmission process can be suppressed, and effective data usable by the external apparatus can be transmitted.

(13) A vehicle-mounted device according to a seventh aspect of the present disclosure includes a sensor data collector that collects sensor data output by a sensor with which a vehicle is equipped, a buffer capable of storing the sensor data collected by the sensor data collector, a transmission device that reads the sensor data collected by the sensor data collector or the sensor data stored in the buffer and transmits the sensor data to an external apparatus, and a state controller that controls a state of the vehicle-mounted device related to the sensor data. The state controller causes the state of the vehicle-mounted device to transition between a finite number of states in accordance with the state of the vehicle-mounted device and a throughput of transmission of the sensor data to the external apparatus by the transmission device.

The state of the vehicle-mounted device changes in accordance with the state and a change in the throughput. By appropriately setting the finite number of states of the vehicle-mounted device in advance, the sensor data can be appropriately processed even when, for example, shadowing occurs.

(14) The finite number of states may include a first state in which the sensor data collected by the sensor data collector is transmitted to the external apparatus by the transmission device, a second state in which the sensor data collected by the sensor data collector is stored in the buffer, and a third state in which the sensor data stored in the buffer is read and is transmitted to the external apparatus via the transmission device.

In the first state, the sensor data is transmitted to the external apparatus, and in the second state, the sensor data is stored in the buffer. In the third state, the sensor data stored in the buffer is transmitted to the external apparatus. By combining these features in accordance with the transmission throughput and transitioning between the states, where appropriate, the process for transmitting the sensor data to the external apparatus, the process for accumulating the sensor data in the buffer without transmitting the sensor data to the external apparatus, and the process for transmitting the sensor data accumulated in the buffer to the outside can be switched and executed in accordance with the state transition.

(15) The state controller may include a first state transitioning unit that causes the state of the vehicle-mounted device to transition from the first state to the second state in response to the throughput changing from a value larger than a threshold value to a value smaller than or equal to the threshold value when the vehicle-mounted device is in the first state, a second state transitioning unit that causes the state of the vehicle-mounted device to transition from the second state to the third state in response to the throughput changing to a value larger than the threshold value when the vehicle-mounted device is in the second state, a third state transitioning unit that causes the state of the vehicle-mounted device to transition from the third state to the first state in response to detection indicating that data does not exist in the buffer when the vehicle-mounted device is in the second state, and a fourth state transitioning unit that causes the state of the vehicle-mounted device to transition from the third state to the second state in response to the throughput becoming smaller than or equal to the threshold value when the vehicle-mounted device is in the third state.

If the throughput decreases when the sensor data is being transmitted to the outside, the vehicle-mounted device transitions to the second state and buffers the sensor data in the buffer. When the throughput is recovered in the second state, the vehicle-mounted device transitions to the third state and transmits the buffered sensor data to the external apparatus. Even when the throughput changes, the sensor data can entirely be transmitted to the external apparatus.

(16) The finite number of states may further include a fourth state in which the sensor data stored in the buffer is read, is converted into sub data having a smaller data size, and is transmitted to the external apparatus via the transmission device. The state controller may further include a fifth state transitioning unit that changes the state of the vehicle-mounted device from the second state to the fourth state in response to when a time in which the vehicle-mounted device is in the second state becomes longer than a threshold time.

When the time in which the sensor data is buffered becomes longer than the threshold time, the sensor data stored in the buffer is sequentially read, is converted into smaller data sizes, and is transmitted to the outside. Even when the time in which the throughput is low continues for a long period of time, only important part of the sensor data can be transmitted to the external apparatus.

(17) The finite number of states may further include a fourth state in which the sensor data collected by the sensor data collector is limited to smaller sub data. The state controller may further include a fifth state transitioning unit that changes the state of the vehicle-mounted device from the second state to the fourth state in response to when a time in which the vehicle-mounted device is in the second state becomes longer than a threshold time.

When the time in which the sensor data is buffered becomes longer than the threshold time, the sensor data collected by the sensor data collector from the sensor is transmitted to the outside while limiting the sensor data to smaller-sized sub data. Even when the time in which the throughput is low continues for a long period of time, only important part of the sensor data can be transmitted to the external apparatus.

(18) The state controller may further include a sixth state transitioning unit that causes the state of the vehicle-mounted device to transition to the third state in response to the throughput becoming larger than the threshold value when the vehicle-mounted device is in the fourth state.

If the throughput is recovered when the sensor data is converted into smaller-sized data and is transmitted to the outside, a state where the sensor data is directly transmitted to the external apparatus is recovered. When the throughput is sufficiently high, the accumulated data can be used externally without being wasted.

(19) The state controller may further include a seventh state transitioning unit that causes the state of the vehicle-mounted device to transition to the first state in response to the throughput becoming larger than the threshold value when the vehicle-mounted device is in the fourth state.

If the throughput is recovered after a state where small-sized sensor data is transmissible is achieved, the acquired sensor data is directly transmitted instead of the accumulated sensor data. The external apparatus can recover the communicable state and can also acquire real-time sensor data, thereby providing a service that uses latest information.

(20) The vehicle-mounted device may further include a data clearing unit that clears the sensor data stored in the buffer in response to when the seventh state transitioning unit causes the state of the vehicle-mounted device to transition from the fourth state to the first state.

In a case where the collected sensor data is to be directly transmitted, the data remains in the buffer. Then, the buffer needs to be cleared to prepare for when the buffer is to be used again. By clearing the buffer, the buffer can be used when the throughput decreases again.

(21) A ratio of a data size after conversion in the fourth state to a data size before conversion may be a monotonically increasing function relative to the throughput.

If the throughput decreases, the transmissible data size decreases accordingly. Therefore, by determining the data size after the conversion using the monotonically increasing function relative to the throughput, sensor data with a data size corresponding to the degree of the throughput can be transmitted to the external apparatus.

(22) A control method for a vehicle-mounted device according to an eighth aspect of the present disclosure includes a step of causing a sensor data collector that collects sensor data output by a sensor, with which a vehicle is equipped, to collect the sensor data, a step of causing a buffer to store the sensor data collected by the sensor data collector, a step of reading the sensor data collected by the sensor data collector or the sensor data stored in the buffer and transmitting the sensor data to an external apparatus, and a step of causing a state controller that controls a state of the vehicle-mounted device related to the sensor data to transition the state of the vehicle-mounted device between a finite number of states in accordance with the state of the vehicle-mounted device and a throughput of transmission of the sensor data to the external apparatus.

The state of the vehicle-mounted device changes in accordance with the state and a change in the throughput. By appropriately setting the finite number of states of the vehicle-mounted device in advance, the sensor data can be appropriately processed even when, for example, shadowing occurs.

(23) A computer program according to a ninth aspect of the present disclosure causes a computer to function as a sensor data collector that collects sensor data output by a sensor with which a vehicle is equipped, a buffer capable of storing the sensor data collected by the sensor data collector, a transmission device that reads the sensor data collected by the sensor data collector or the sensor data stored in the buffer and transmits the sensor data to an external apparatus, and a state controller that causes a state of the vehicle-mounted device related to the sensor data to transition between a finite number of states in accordance with the state of the vehicle-mounted device and a throughput of transmission of the sensor data to the external apparatus by the transmission device.

The state of the vehicle-mounted device changes in accordance with the state and a change in the throughput. By appropriately setting the finite number of states of the vehicle-mounted device in advance, the sensor data can be appropriately processed even when, for example, shadowing occurs.

DETAILS OF EMBODIMENTS OF PRESENT DISCLOSURE

In the following embodiments, the same components are given the same reference signs. The names and functions of these components are also the same. Therefore, detailed descriptions of these components will not be repeated.

First Embodiment

Overall Configuration

Referring to FIG. 1, a driving assistance system 100 according to a first embodiment of the present disclosure includes a server 102 and a vehicle-mounted device 120 that is installed in a vehicle 106 and that communicates with the server 102 via a base station 104 and a network 108. The server 102 provides driving assistance information to the vehicle-mounted device 120 so as to assist the driver of the vehicle 106. The base station 104 provides a mobile communication service by using, for example, a 5G line. The server 102 and the base station 104 communicate with each other via the network 108 in a wired or wireless manner.

The vehicle-mounted device 120 has a 5G-line-based communication function. Alternatively, the communication function of the vehicle-mounted device 120 may be based on a line other than the 5G line. A detection target 110 is a target to be detected by a vehicle-mounted sensor of the vehicle 106. Although a person is illustrated in FIG. 1, the target is not limited to this and may be a traffic light, a building, and so on.

A single base station is representatively illustrated in FIG. 1, but the number of base stations is not limited thereto. Normally, a plurality of base stations are provided. With regard to the vehicle, a single vehicle is representatively illustrated in FIG. 1, but the number of vehicles is not limited thereto. The server 102 communicates with vehicle-mounted devices of a larger number of vehicles, collects and analyzes information, and provides driving assistance information.

Hardware Configuration of Vehicle-Mounted Device

Figure 2:
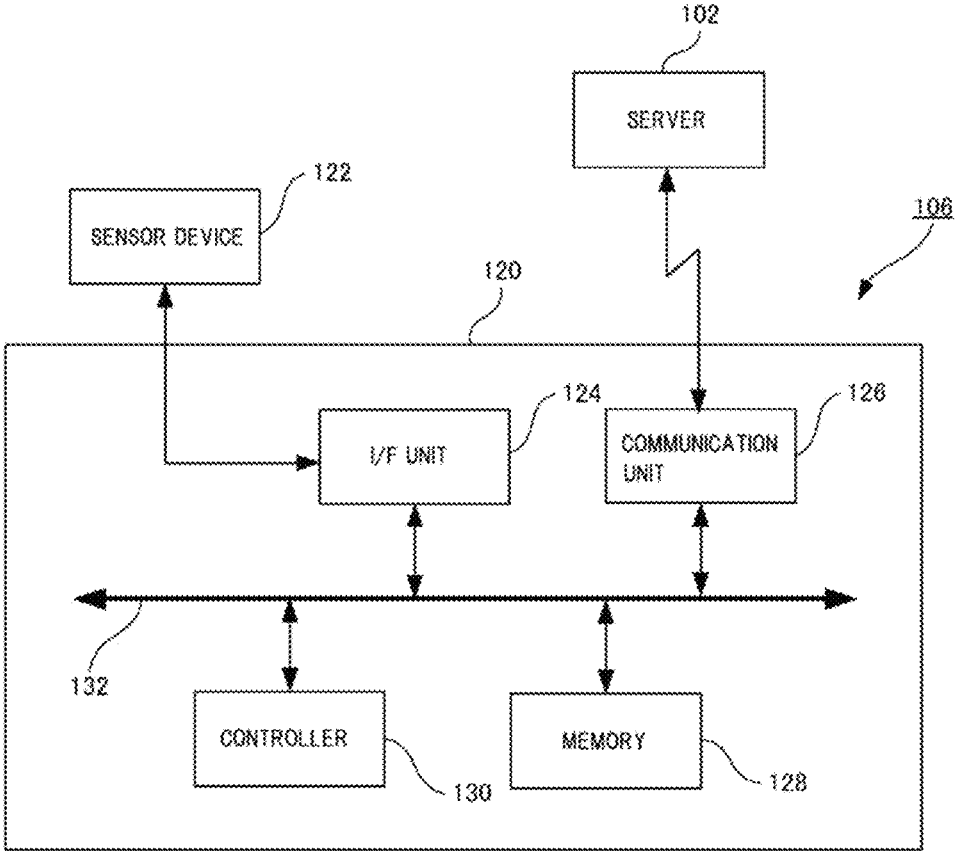
FIG. 2 is a block diagram illustrating a hardware configuration of a vehicle-mounted device.

Referring to FIG. 2, an example of a hardware configuration of the vehicle-mounted device 120 installed in the vehicle 106 is illustrated. The vehicle-mounted device 120 includes an interface unit (referred to as "I/F unit" hereinafter) 124 connected to a sensor device 122, a communication unit 126 that performs communication, a memory 128 that stores data, a controller 130 that controls these components, and a bus 132 for exchanging data between the components. In addition to the components illustrated in FIG. 2, the vehicle-mounted device 120 also includes components necessary for functioning as a vehicle-mounted device, such as a timer and a power supply device.

The sensor device 122 is a sensor installed in the vehicle 106. Although various sensors are installed in the vehicle, the sensor device 122 among these various sensors is provided for generating driving assistance information. Examples of the sensor device 122 include an image sensor (such as a CCD (charge-coupled device) camera or a CMOS (complementary metal-oxide-semiconductor) camera), a laser sensor (such as LiDAR (light detection and ranging)), and a millimeter-wave radar. The sensor device 122 detects a target and outputs a predetermined detection signal (i.e., an analog signal or digital data).

The detection signal obtained by the sensor device 122 is input to the I/F unit 124. The I/F unit 124 includes an A/D converter. When receiving an analog signal, the I/F unit 124 generates digital data (i.e., sensor data) by sampling the analog signal at a predetermined frequency, and outputs the digital data. The generated digital data is transmitted to and stored in the memory 128. If the output signal from the sensor device 122 is digital data, the I/F unit 124 stores the input digital data in the memory 128. The memory 128 is, for example, a rewritable nonvolatile semiconductor memory or a hard disk drive (referred to as "HDD" hereinafter).

Information (such as a time stamp, which will be referred to as "sensor-data acquisition time point" hereinafter) that specifies a time point at which sensor data is acquired and information (referred to as "vehicle location" hereinafter) indicating the location of the vehicle 106 corresponding to the sensor-data acquisition time point are added to the sensor data stored in the memory 128. For example, if the sensor device 122 is an image sensor, the sensor-data acquisition time point and the vehicle location are added to the sensor data in units of frames. The sensor-data acquisition time point is acquired from the timer, and the vehicle location is acquired from the GPS (global positioning system).

The communication unit 126 has a 5G-line-based mobile communication function and communicates with the server 102. The communication between the vehicle-mounted device 120 and the server 102 is performed via the base station 104 and the network 108. The communication unit 126 is constituted of, for example, an IC for performing modulation and multiplexing employed in the 5G line, an antenna for radiating and receiving a radio wave with a predetermined frequency, and an RF (radio frequency) circuit.

The controller 130 includes a CPU (central processing unit) and controls the individual components to realize the functions of the vehicle-mounted device 120 to be described later.

Hardware Configuration of Server

Figure 3:
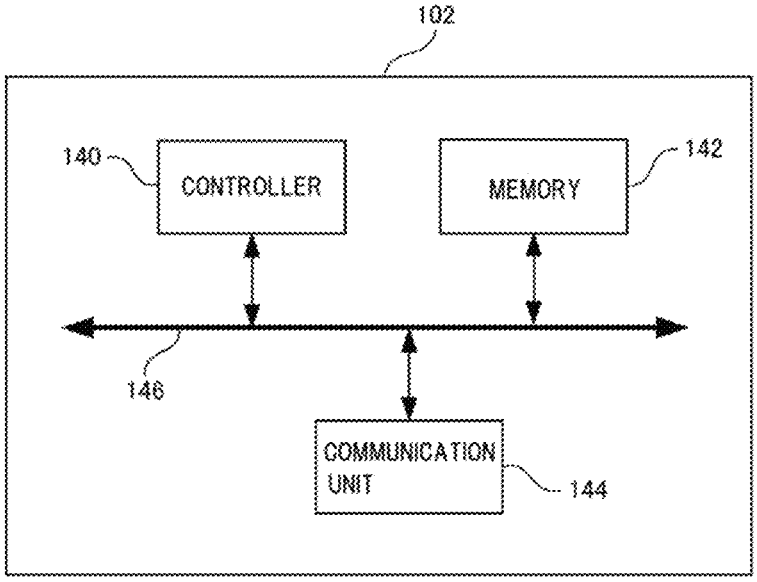
FIG. 3 is a block diagram illustrating a hardware configuration of a server.

Referring to FIG. 3, the server 102 includes a controller 140, a memory 142, a communication unit 144, and a bus 146. Data transmission between the components is performed via the bus 146. The controller 140 includes, for example, a CPU and controls the individual components to realize various functions of the server 102. The communication unit 144 receives sensor data uploaded from the vehicle 106 via the base station 104 and the network 108. The memory 142 includes a mass storage device, such as a rewritable nonvolatile semiconductor memory and an HDD. The data received by the communication unit 144 is transmitted to the memory 142 and is stored therein as a database.

Functional Configuration of Vehicle-Mounted Device

The functions of the vehicle-mounted device 120 will now be described with reference to FIG. 4. The vehicle-mounted device 120 includes a sensor data collector 200 that collects sensor data detected by the sensor device 122, a sensor data processor 190 that processes the sensor data collected by the sensor data collector 200 to generate a packet to be uploaded to the server 102, a packet transmitter 216 that transmits the packet generated by the sensor data processor 190 to the server 102, and a packet receiver 218 that receives the packet from the server 102.

The sensor data processor 190 includes a buffer input controller 202, a buffer unit 204, a buffer output controller 212, and a shadowing detector 214. The buffer unit 204 includes a first buffer 206, a second buffer 208, and a third buffer 210.

The sensor data collector 200 collects sensor data detected by the sensor device 122. The buffer input controller 202 outputs the sensor data input from the sensor data collector 200 to the packet transmitter 216 if there is no communication failure with the base station 104, or outputs the sensor data to the buffer unit 204 if there is a failure. As mentioned above, the sensor data to be output from the buffer input controller 202 has the sensor-data acquisition time point and the vehicle location of the vehicle 106 corresponding to the sensor-data acquisition time point added thereto. A communication failure with the base station 104 in this case is an occurrence of shadowing. Information about the occurrence of shadowing is transmitted from the shadowing detector 214 to be described later.

Figure 5:
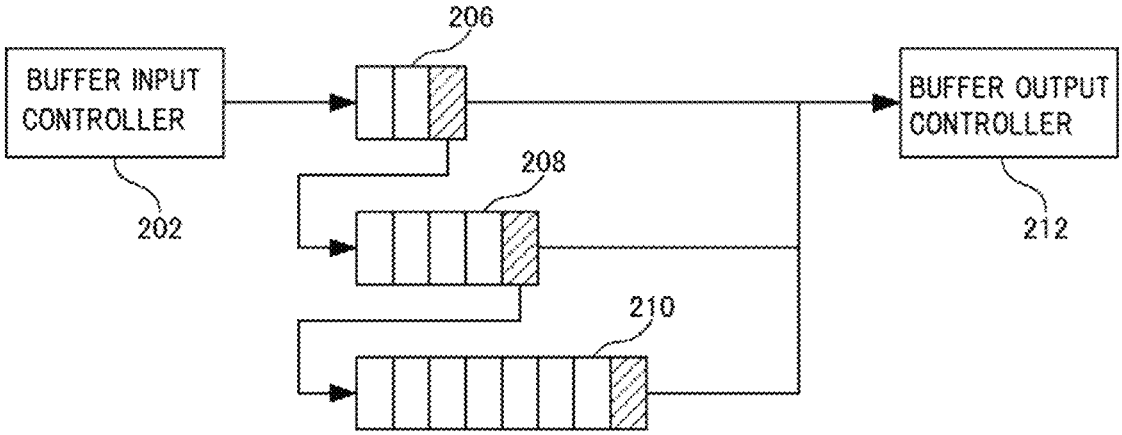
FIG. 5 is a block diagram illustrating the configuration of buffers.

The first buffer 206, the second buffer 208, and the third buffer 210 have predetermined buffer capacities and sequentially store input data. The first buffer 206, the second buffer 208, and the third buffer 210 are ensured on, for example, the memory 128. As illustrated in FIG. 5, it is assumed that the buffer capacities are ensured such as to increase in the following order: the first buffer 206, the second buffer 208, and the third buffer 210. In a case where the buffer input controller 202 is to output sensor data to the buffer unit 204, the buffer input controller 202 outputs the sensor data to the first buffer 206. The first buffer 206, the second buffer 208, and the third buffer 210 each store the input data, shifts the previously-stored data (rightward in FIG. 5) when new data is to be input, and subsequently stores the newly-input data in an available region. If data to be stored exceeds the buffer capacity and causes overflowing, each of the first buffer 206, the second buffer 208, and the third buffer 210 functions as follows. Specifically, referring to FIG. 5, if overflowing occurs in the first buffer 206, the oldest data (indicated as a shaded region in FIG. 5) of the data stored in the first buffer 206 is output to the second buffer 208. If overflowing occurs in the second buffer 208, the oldest data (indicated as a shaded region in FIG. 5) of the data stored in the second buffer 208 is output to the third buffer 210. If overflowing occurs in the third buffer 210, the oldest data (indicated as a shaded region in FIG. 5) of the data stored in the third buffer 210 is discarded.

With such a configuration, the first buffer 206 stores data with the shortest delay time (i.e., the difference between the time point at which the sensor data is acquired by the vehicle-mounted device 120 and a specific time point (i.e., the current time point or the time point at which the sensor data is received by the server 102)) (e.g., delay time≤several hundred milliseconds). The second buffer 208 stores data with a longer delay time than the data stored in the first buffer 206 (e.g., several hundred milliseconds<delay time≤several seconds). The third buffer 210 stores data with a longer delay time than the data stored in the second buffer 208 (e.g., several seconds<delay time≤several minutes). The sensor data stored in the first buffer 206, the sensor data stored in the second buffer 208, and the sensor data stored in the third buffer 210 are also called real-time data, semi-real-time data, and non-real-time data, respectively. The time at which each preset buffer stores data (i.e., the sensor data, the sensor-data acquisition time point, and the vehicle location) and the buffer capacity corresponding thereto may be set in accordance with a delay time (e.g., the difference between the sensor-data acquisition time point and a processing completion time point of the sensor data) permitted to the sensor data to be used in a service (such as a service for providing driving assistance information) provided by the server 102. An upper limit for the delay time permitted to each service will be referred to as "permissible delay time" hereinafter. As described above, a plurality of buffer regions are provided in accordance with the delay times (also referred to as "real-time-ness" hereinafter) of sensor data, and information with higher real-time-ness can thus be transmitted with priority. With the buffer capacities being set in accordance with the real-time-ness of sensor data, appropriate buffer capacities can be set. The storage time of each buffer mentioned above is an example, and data may be stored therein within a time range different from the above. As will be described later, the storage time (i.e., the corresponding buffer capacity) of each buffer may be set in accordance with a service executed by the server 102.

If there is no communication failure with the base station, the buffer output controller 212 concurrently reads sensor data from the first buffer 206, the second buffer 208, and the third buffer 210 and outputs the sensor data to the packet transmitter 216. For example, the buffer output controller 212 reads the oldest data (i.e., the shaded region in FIG. 5) from each of the first buffer 206, the second buffer 208, and the third buffer 210. In this case, the buffer output controller 212 reads sensor data with the shorter delay time with priority. Specifically, the priority level for reading data decreases in the following order: the first buffer 206, the second buffer 208, and the third buffer 210. Therefore, at the initial stage of the reading process, data is not to be read from a specific buffer alone, but is read concurrently from the first buffer 206, the second buffer 208, and the third buffer 210. As time elapses, the first buffer 206 and the second buffer 208 have no data to be read therefrom in that order, such that data is read from the third buffer 210 alone at the final stage. The buffer output controller 212 adds, to the sensor data, information for specifying the delay time of the sensor data read from each of the first buffer 206, the second buffer 208, and the third buffer 210, and outputs the sensor data with the added information to the packet transmitter 216. For example, the buffer output controller 212 adds, to the sensor data, classification information indicating real-time data, semi-real-time data, and non-real-time data, and outputs the sensor data with the added classification information to the packet transmitter 216. When the buffer output controller 212 outputs all the sensor data buffered in the first buffer 206, the second buffer 208, and the third buffer 210 to the packet transmitter 216, the buffer output controller 212 outputs predetermined information (referred to as "output completion information" hereinafter) to the shadowing detector 214.

The packet transmitter 216 packetizes input data (i.e., adds header data, splits the input data, and so on) in accordance with a communication protocol, and transmits the data. If the data input to the packet transmitter 216 is buffered data, the data has classification information added thereto (i.e., contains the sensor data, the sensor-data acquisition time point, the vehicle location, and the classification information). Otherwise, the data does not have classification information added thereto (i.e., contains the sensor data, the sensor-data acquisition time point, and the vehicle location). The transmission of buffer data concurrently read from the first buffer 206, the second buffer 208, and the third buffer 210 in accordance with the priority levels may also be referred to as "concurrent uploading" hereinafter. In this case, the expression "concurrent uploading (concurrent transmission)" may be any one of or a combination of a mode (1) involving reading a plurality of types of data one by one, grouping and assembling the plurality of types of data into a single packet, and transmitting the packet, a mode (2) involving reading a plurality of types of data one by one, assembling the plurality of types of data individually into different packets, and transmitting the packets successively via a single wireless communication device, a mode (3) involving reading a plurality of types of data one by one, creating a single piece of data containing the plurality of types of data linked with each other, splitting the single piece of data into a plurality of packets, and transmitting the packets, and a mode (4) involving, if there are a plurality of wireless transmission devices, reading a plurality of types of data one by one to assemble different packets, and transmitting the packets substantially at the same time via the different wireless transmission devices. Furthermore, the packet transmitter 216 calculates the frequency of a transmission failure or the line speed of the communication line, and outputs the frequency or the line speed to the shadowing detector 214. As will be described later, this is for the shadowing detector 214 to determine whether or not a communication failure with the base station has occurred.

The packet receiver 218 receives data transmitted from the base station 104. The packet receiver 218 can determine, based on reception of reception confirmation information transmitted from the transmission destination, whether or not packet data transmitted from the packet transmitter 216 has been received by a transmission destination. For example, in the case of a TCP/IP protocol, this can be determined based on reception of ACK and a confirmation response number (indicating the header of next data to be transmitted (i.e., indicating how much data has been received)). If the packet receiver 218 does not receive reception confirmation information within a predetermined time period, it is determined that the transmission has failed, and the packet transmitter 216 retransmits the relevant packet data.

The shadowing detector 214 determines whether or not shadowing is occurring based on the frequency of a communication failure input from the packet transmitter 216 or the line speed of the communication line. If the shadowing detector 214 determines that shadowing is occurring, the shadowing detector 214 outputs a predetermined command (referred to as "buffer start command" hereinafter) to the buffer input controller 202. When the buffer input controller 202 receives the buffer start command, the buffer input controller 202 changes the output destination for the sensor data input from the sensor data collector 200 from the packet transmitter 216 to the buffer unit 204. Accordingly, as described above, the first buffer 206, the second buffer 208, and the third buffer 210 execute buffering (i.e., storing) of the sensor data.

In a case where the shadowing detector 214 determines that the shadowing that has occurred is resolved, the shadowing detector 214 outputs a predetermined command (referred to as "transmission start command" hereinafter) to the buffer input controller 202 and the buffer output controller 212. When the buffer input controller 202 receives the transmission start command, the buffer input controller 202 stops outputting the sensor data input from the sensor data collector 200. When the buffer output controller 212 receives the transmission start command, the buffer output controller 212 concurrently reads data from the first buffer 206, the second buffer 208, and the third buffer 210, as described above, adds corresponding classification information to the read data, and outputs the data with the classification information added thereto to the packet transmitter 216. When the buffer output controller 212 completely outputs all the buffer data, the buffer output controller 212 outputs output completion information to the shadowing detector 214. The shadowing detector 214 receiving the output completion information outputs a predetermined command (referred to as "buffer termination command" hereinafter) to the buffer input controller 202. When the buffer input controller 202 receives the buffer termination command, the buffer input controller 202 sets the output destination for the sensor data input from the sensor data collector 200 back to the packet transmitter 216 from the buffer unit 204.

Accordingly, the vehicle-mounted device 120 buffers the sensor data during a period in which shadowing is occurring, and can concurrently transmit the buffered sensor data when the shadowing is resolved. In this case, since the buffered sensor data is transmitted such that data with a shorter delay time is transmitted with priority, the server 102 can effectively use the received sensor data. This will be described later.

The function of the sensor data collector 200 is realized by the I/F unit 124 in FIG. 2. The functions of the packet transmitter 216 and the packet receiver 218 are realized by the communication unit 126. The functions of the buffer input controller 202, the buffer unit 204, the buffer output controller 212, and the shadowing detector 214 are realized by the controller 130 and the memory 128. The individual functions of the vehicle-mounted device 120 may be realized by using dedicated hardware (such as a circuit board or a semiconductor integrated circuit (e.g., ASIC)). For example, the functions of the buffer input controller 202, the buffer unit 204, the buffer output controller 212, and the shadowing detector 214 surrounded by a single-dot chain line in FIG. 4 may be realized by one or more semiconductor integrated circuits, and the controller 130 and the memory 128 may be installed as separate components in the vehicle-mounted device 120.

Functional Configuration of Server

The function of the server 102 will now be described with reference to FIG. 6. The server 102 includes a packet receiver 240 that receives packet data, a filter unit 244 that classifies data output from the packet receiver 240 in accordance with a predetermined condition and inputs the output data to a database 246, a processor 254 that executes predetermined processing on the data stored in the database 246, and a packet transmitter 242 that transmits a processing result of the processor 254 as driving assistance information.

The database 246 includes a real-time data region 248, a semi-real-time data region 250, and a non-real-time data region 252. The database 246 is realized by the memory 142 (see FIG. 3). The real-time data region 248, the semi-real-time data region 250, and the non-real-time data region 252 are regions for storing sensor data according to the delay times. The real-time data region 248 is a region for storing real-time sensor data. The semi-real-time data region 250 is a region for storing semi-real-time sensor data. The non-real-time data region 252 is a region for storing non-real-time sensor data.

The packet receiver 240 receives sensor data from a vehicle-mounted device, such as the vehicle-mounted device 120, of the vehicle 106. In addition to the vehicle-mounted device, the packet receiver 240 receives sensor data from a fixedly-installed infrastructure sensor, such as a street monitoring camera. Examples of the infrastructure sensor include an image sensor (such as a camera), a laser sensor (such as a LiDAR), and a millimeter radar. When the packet receiver 240 receives packet data containing the sensor data transmitted from the vehicle-mounted device 120, the packet receiver 240 extracts the sensor data and information added thereto (also referred to as "additional information" hereinafter) from the packet data if there is additional information, and outputs the sensor data and the additional information to the filter unit 244. The function of the packet receiver 240 is realized by the communication unit 144 in FIG. 3. The additional information includes the sensor-data acquisition time point, the vehicle location, and the classification information (i.e., information indicating the classification of the delay time of the sensor data) mentioned above.

The filter unit 244 stores the input sensor data, sensor-data acquisition time point, and vehicle location in any one of the real-time data region 248, the semi-real-time data region 250, and the non-real-time data region 252 in accordance with the classification information. In the vehicle-mounted device 120, classification information is added only to sensor data (i.e., buffered data) to be transmitted when shadowing that has occurred is resolved, and is not added to sensor data to be transmitted in a normal state. Moreover, classification information is not added to sensor data received from an infrastructure sensor. The filter unit 244 outputs sensor data not having classification information added thereto as data with high real-time-ness to the real-time data region 248.

Because the real-time-ness of the data stored in the real-time data region 248, the semi-real-time data region 250, and the non-real-time data region 252 changes as time elapses, data transfer between the regions and data deletion are performed, where appropriate, so that the real-time-ness of the sensor data stored in each of the real-time data region 248, the semi-real-time data region 250, and the non-real-time data region 252 is maintained. For example, as a result of checking the sensor-data acquisition time point, data that is stored in the real-time data region 248 and that no longer represents real-time data as time elapses is transferred to the semi-real-time data region 250. Likewise, data that is stored in the semi-real-time data region 250 and that no longer represents semi-real-time data is transferred to the non-real-time data region 252. Data that is stored in the non-real-time data region 252 and that no longer represents non-real-time data is deleted.

The processor 254 reads sensor data from each of the real-time data region 248, the semi-real-time data region 250, and the non-real-time data region 252 at a predetermined timing and executes a process according to the delay time of the read sensor data. The process performed by the processor 254 includes, for example, performing a moving-object detection process on the sensor data read from the real-time data region 248, identifying the attributes (such as the type (i.e., human, vehicle, etc.), the location, and the size) of the detected moving body, generating driving assistance information, and reflecting the driving assistance information on a traffic condition map. The processor 254 uses the sensor data read from the real-time data region 248 and the semi-real-time data region 250 in a process for estimating a future behavior of a detection target. For example, the processor 254 predicts specific attributes of the moving body (e.g., the attributes of a pedestrian if a pedestrian is detected (e.g., a child, an elderly person, a walking mode, the walking speed, the walking direction, and a stopped mode)) detected from the sensor data from the real-time data region 248. The sensor data read from the semi-real-time data region 250 may be used as a past sample in the behavior estimation process. The processor 254 uses the sensor data read from the non-real-time data region 252 as data targeted for a statistical process, such as a statistical analysis, as well as learning data for constructing an estimation model. The processing result of the processor 254 is stored in an analysis result region 256 of the database 246, is read by the packet transmitter 242, where appropriate, and is transmitted as driving assistance information to the vehicle-mounted device.

As described above, the server 102 classifies and stores sensor data received from a vehicle-mounted device, such as the vehicle-mounted device 120, and an infrastructure sensor in accordance with the real-time-ness, and can use the stored sensor data in accordance with the real-time-ness thereof.

Operation

Figure 7:
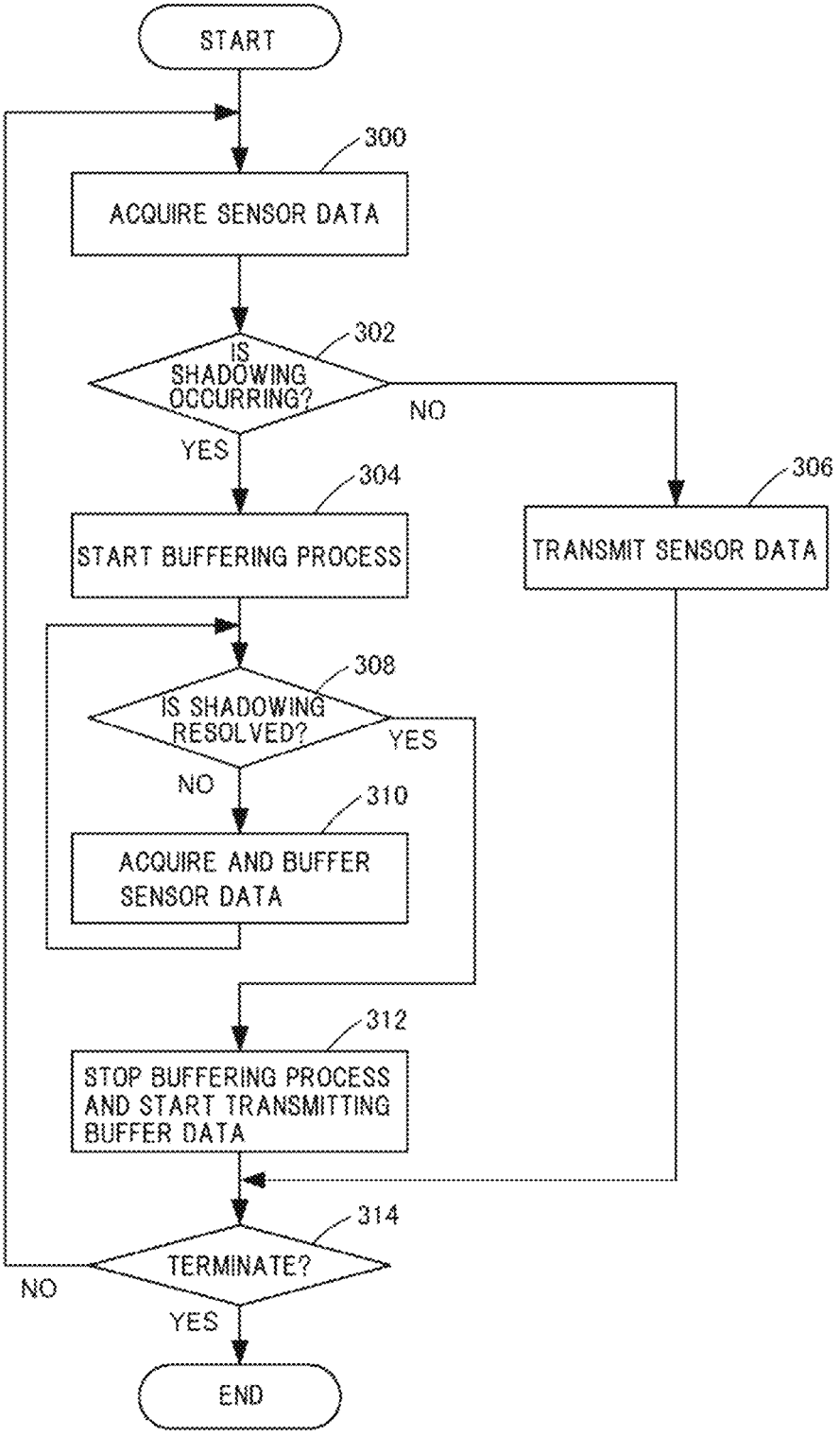
FIG. 7 is a flowchart illustrating the operation of the vehicle-mounted device.
Figure 8:
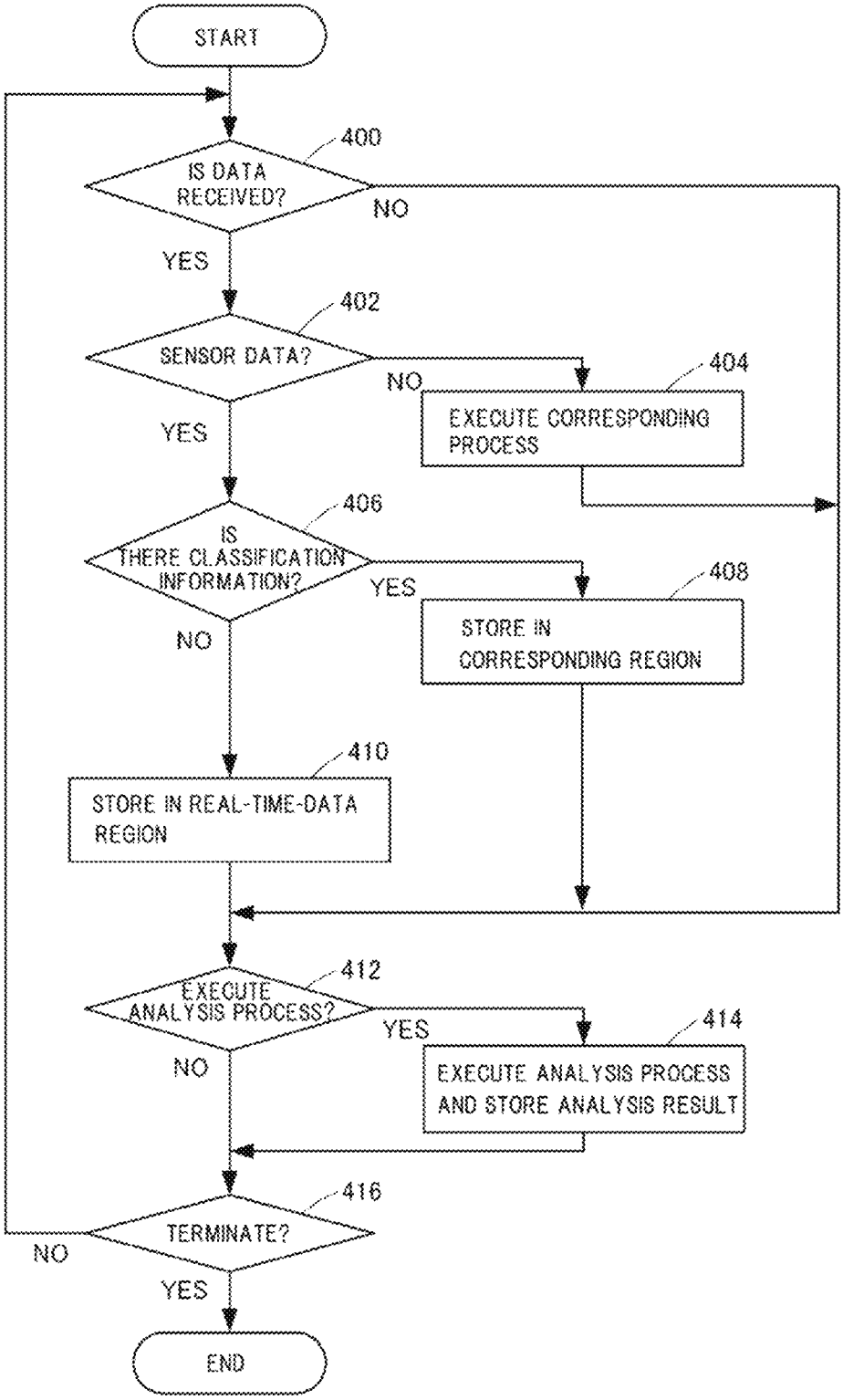
FIG. 8 is a flowchart illustrating the operation of the server.

The operation of the driving assistance system 100 will now be described by describing the operation of the vehicle-mounted device 120 and the server 102 with reference to FIG. 7 and FIG. 8. A process illustrated in FIG. 7 is realized by the controller 130 reading a predetermined program from the memory 128 and executing the program. A process illustrated in FIG. 8 is realized by the controller 140 reading a predetermined program from the memory 142 and executing the program.

Operation of Vehicle-Mounted Device

Referring to FIG. 7, in step 300, the controller 130 acquires sensor data from the sensor device 122.

In step 302, the controller 130 determines whether or not shadowing is occurring. In addition to an increase in the frequency of a transmission failure and a decrease in the line speed mentioned above, an occurrence of shadowing can also be determined based on, for example, a decrease in the reception signal level or a communication disconnection with the server 102. This corresponds to the function of the shadowing detector 214 in FIG. 4. If it is determined that shadowing is occurring, the control proceeds to step 304. Otherwise, the control proceeds to step 306.

In step 304, the controller 130 starts to buffer the sensor data acquired in step 300. This corresponds to the functions of the buffer input controller 202 and the buffer unit 204 in FIG. 4. For example, the sensor data is buffered by being categorized as real-time data, semi-real-time data, or non-real-time data in accordance with the delay time thereof. Subsequently, the control proceeds to step 308.

In contrast, if it is determined in step 302 that shadowing is not occurring, the sensor data acquired in step 300 is transmitted to the server 102 in step 306. This corresponds to the functions of the buffer input controller 202 and the packet transmitter 216 in FIG. 4.

In step 308, the controller 130 determines whether or not the shadowing is resolved. If it is determined that the shadowing is resolved, the control proceeds to step 312. Otherwise, the control proceeds to step 310.

In step 310, the controller 130 acquires sensor data and buffers the acquired sensor data as described above. Subsequently, the control returns to step 308. Accordingly, when shadowing is occurring, the sensor data is buffered and is not to be transmitted.

When the shadowing is resolved, the controller 130 stops the buffering process in step 312 and starts a process for transmitting the buffered data to the server 102. This corresponds to the functions of the buffer output controller 212 and the packet transmitter 216 in FIG. 4. The buffered data categorized as real-time data, semi-real-time data, and non-real-time data are concurrently uploaded. In this case, data with higher real-time-ness is transmitted with priority. Subsequently, the control proceeds to step 314.

In step 314, the controller 130 determines whether or not a termination command is given. A termination command is given when, for example, the power of the vehicle-mounted device 120 is turned off. When it is determined that a termination command is given, the program ends. Otherwise, the control returns to step 300.

As described above, if shadowing is not occurring, the vehicle-mounted device 120 repeats the process of receiving sensor data and transmitting the sensor data to the server 102. Once shadowing occurs, the vehicle-mounted device 120 buffers the sensor data while the shadowing is occurring, and can concurrently upload the buffered sensor data when the shadowing is resolved. In this case, the buffered sensor data is transmitted such that data with a shorter delay time is transmitted with priority. Therefore, when shadowing occurs, a wasteful process of repeating retransmission of data can be suppressed. Moreover, when the shadowing is resolved, sensor data with higher real-time-ness is transmitted with priority, and the server 102 can thus effectively use the received data, thereby inhibiting the received data from being discarded without being used.

Operation of Server

Referring to FIG. 8, the controller 140 determines in step 400 whether or not data is received. If it is determined that data is received, the control proceeds to step 402. Otherwise, the control proceeds to step 412.

In step 402, the controller 140 determines whether or not the data received in step 400 is sensor data. For example, when sensor data from the vehicle-mounted device 120 is to be packetized and transmitted, the packet header to be transmitted may include information indicating that it contains the sensor data. If the received packet header includes the information, the controller 140 can determine that the sensor data is received. If it is determined that the sensor data is received, the control proceeds to step 406. Otherwise, the control proceeds to step 404.

In step 404, the controller 140 executes a corresponding process in response to the received data. Subsequently, the control proceeds to step 412.

In step 406, the controller 140 determines whether or not the data received in step 400 contains classification information (i.e., information indicating the real-time-ness of the sensor data). If it is determined that the data contains classification information, the control proceeds to step 408. Otherwise, the control proceeds to step 410.

In step 408, the controller 140 stores the sensor data received in step 400 in a relevant region of the memory 142 corresponding to the received classification information. This corresponds to the functions of the filter unit 244 and the database 246 in FIG. 6. The sensor data is stored in the real-time data region 248, the semi-real-time data region 250, or the non-real-time data region 252 in accordance with the classification information.

In step 410, the controller 140 stores the sensor data (not containing classification information) received in step 400 in a real-time-data storage region (i.e., the real-time data region 248 in FIG. 6) of the memory 142. Then, the control proceeds to step 412.

In step 412, the controller 140 determines whether or not to execute an analysis process on the stored sensor data. If it is determined that an analysis process is to be executed, the control proceeds to step 414. Otherwise, the control proceeds to step 416. For example, the controller 140 determines to execute an analysis process if new sensor data is received. Furthermore, if an analysis process is set such as to be executed at predetermined time intervals, the controller 140 determines whether or not to execute an analysis process in accordance with the time elapsed from the execution of the previous analysis process.

Figure 6:
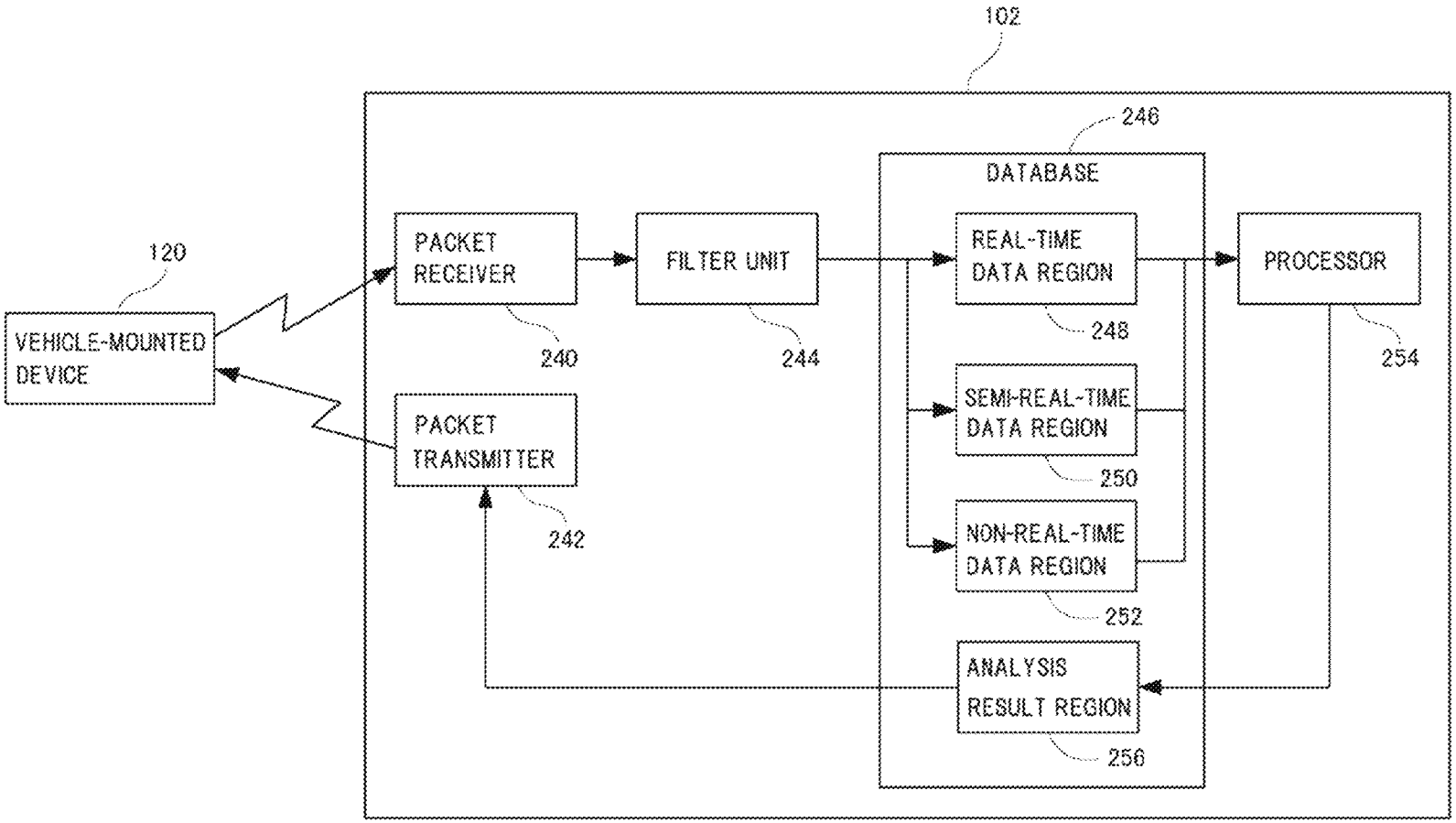
FIG. 6 is a block diagram illustrating a functional configuration of the server.

In step 414, the controller 140 executes an analysis process on the sensor data stored in the memory 142 (i.e., the real-time data region 248, the semi-real-time data region 250, and the non-real-time data region 252 in FIG. 6) in accordance with the real-time-ness thereof. This corresponds to the function of the processor 254 in FIG. 6. The controller 140 stores the analysis result in the memory 142 (i.e., the analysis result region 256 in FIG. 6). Subsequently, the control proceeds to step 416.

In step 416, the controller 140 determines whether or not a termination command is given. For example, a termination command is given as a command for stopping the program in progress. When a termination command is received, the program ends. If a termination command is not received, the control returns to step 400.

As described above, the server 102 classifies and stores sensor data received from a vehicle-mounted device, such as the vehicle-mounted device 120, and an infrastructure sensor in accordance with the real-time-ness thereof, and can use the stored sensor data in accordance with the real-time-ness thereof. In particular, sensor data (i.e., buffer data) that is not transmissible for a predetermined period due to the occurrence of shadowing in the vehicle-mounted device 120 and that is to be transmitted after the shadowing is resolved can be classified and stored in accordance with the real-time-ness thereof without being discarded, and can be effectively used in accordance with the real-time-ness thereof.

The above description relates to a case where sensor data is buffered when shadowing occurs, but the configuration case is not limited thereto. Alternatively, sensor data may be buffered in the event of a phenomenon where normal communication is temporarily not possible within a service area of a base station due to a factor other than shadowing, and the buffer data may be concurrently uploaded when a normal communicable state is recovered.

First Modification

The above description relates to a case where each buffer capacity used for buffering sensor data by the vehicle-mounted device when shadowing occurs is fixed, but the configuration is not limited thereto. Alternatively, the buffer capacity may be changeable, where appropriate. In a first modification, the vehicle-mounted device changes the buffer capacity in accordance with parameters transmitted from the server.

Functional Configuration of Vehicle-Mounted Device

Figure 9:
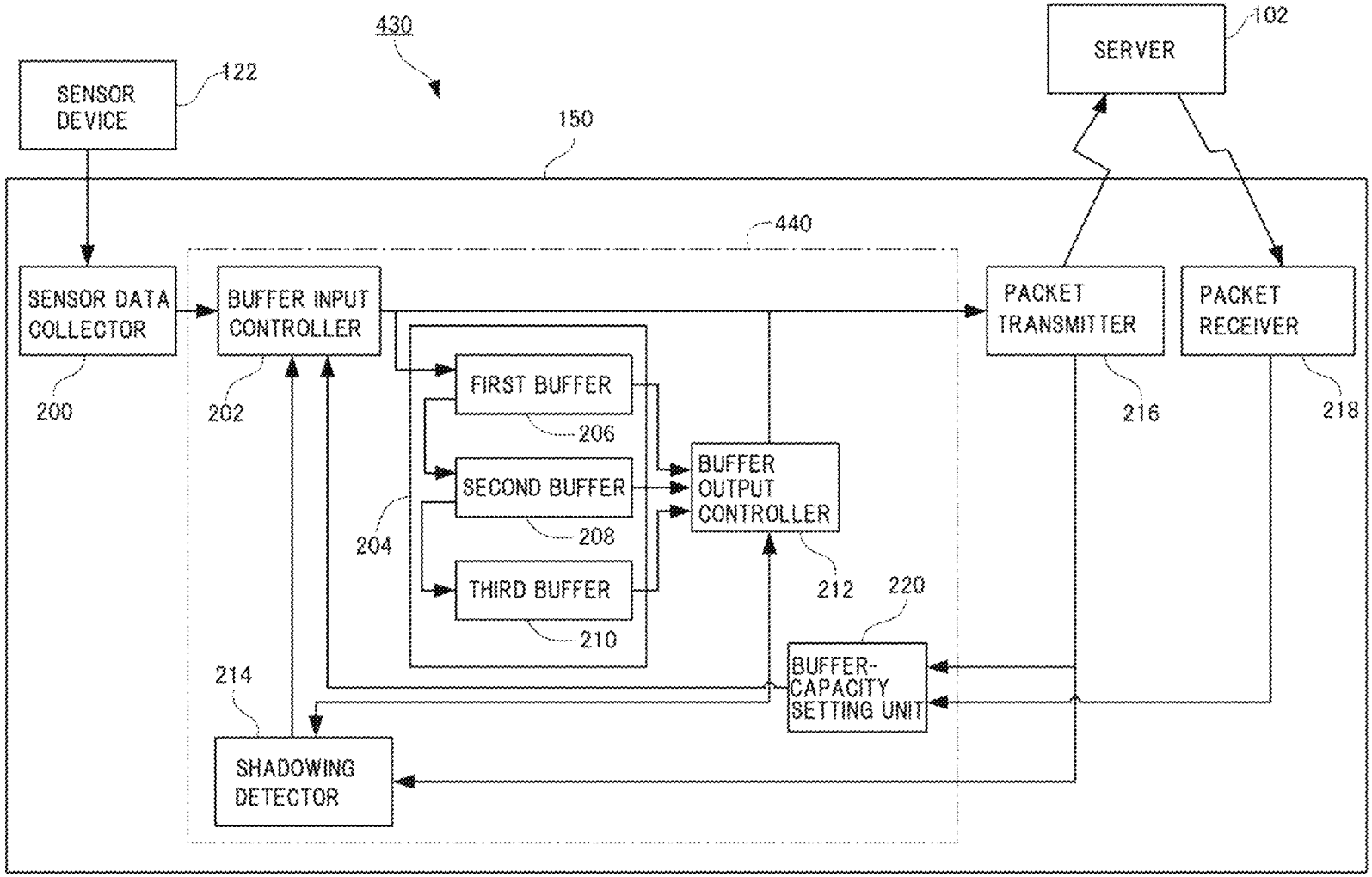
FIG. 9 is a block diagram illustrating a functional configuration of a vehicle-mounted device according to a first modification of the first embodiment of the present disclosure.

The hardware configuration of the vehicle-mounted device according to the first modification is the same as that in FIG. 2. Referring to FIG. 9, a vehicle 430 includes a vehicle-mounted device 150 according to the first modification. The functional configuration of the vehicle-mounted device 150 is different from that of the vehicle-mounted device 120 in FIG. 4 in simply including a sensor data processor 440 in place of the sensor data processor 190 in FIG. 4. The sensor data processor 440 is obtained by adding a buffer-capacity setting unit 220 to the sensor data processor 190. As will be described later, the buffer-capacity setting unit 220 receives, from the packet receiver 218, parameters transmitted from the server 102 and received by the packet receiver 218, and sets the capacity of each buffer based on information (i.e., line speed) input from the packet transmitter 216 and the parameters. In the vehicle-mounted device 150, components given reference signs identical to those of the components of the vehicle-mounted device 120 (FIG. 4) have functions identical to those of the components of the vehicle-mounted device 120. Therefore, redundant descriptions will not be repeated. The following description mainly relates to differences.

It is assumed here that, at the point when the vehicle-mounted device 150 starts operating, the buffer capacities of the first buffer 206, the second buffer 208, and the third buffer 210 are set in advance. Similarly to the vehicle-mounted device 120, when shadowing occurs, the vehicle-mounted device 150 stops transmitting sensor data output from the sensor data collector 200, and starts performing a buffering process with respect to the buffer unit 204 (i.e., changes the output destination for the buffer input controller 202 from the packet transmitter 216 to the buffer unit 204). Then, when the shadowing is resolved, the pieces of data buffered in the first buffer 206, the second buffer 208, and the third buffer 210 are concurrently read and transmitted (concurrently uploaded) from the packet transmitter 216. The pieces of data in the first buffer 206, the second buffer 208, and the third buffer 210 are concurrently read (by the function of the buffer output controller 212) and transmitted in accordance with real-time-ness-based priority levels (the priority levels decrease in the first buffer 206, the second buffer 208, and the third buffer 210 in that order). In this case, each packet data transmitted from the packet transmitter 216 contains information indicating a transmission time point.

Accordingly, the server 102 receives data (i.e., sensor data) buffered during the period of the shadowing, and effectively uses the data. When concurrent uploading is being performed, the server 102 measures (i.e., calculates) the line speed, the time difference (referred to as "transmission delay time" hereinafter) between the transmission time point and the acquisition time point of the received data, and the time (referred to as "processing delay time" hereinafter) required for analyzing the received data (i.e., sensor data), as will be described later. The measured line speed is quantized and stored. The transmission delay time and the processing delay time are calculated for each classification information (i.e., information indicating the delay time of sensor data) mentioned above. Specifically, the server 102 evaluates the performance of concurrent uploading when the vehicle-mounted device 150 performs the concurrent uploading. The server 102 transmits these parameters to the vehicle-mounted device 150 at an appropriate timing. The parameters are transmitted as, for example, a group of {line speed, classification information, transmission delay time, processing delay time}.

The server 102 also transmits the permissible delay time of each service. A service that uses sensor data varies depending on the real-time-ness of the sensor data. For example, for generating driving assistance information, real-time data can be used, but non-real-time data cannot be used. Sensor data with a delay time exceeding the permissible delay time cannot be used in a corresponding service. The permissible delay time is set for each classification information. The permissible delay time may be shared between the server and the vehicle-mounted device and may be set in advance as a specification if the permissible delay time is not variable. For example, the permissible delay time may be initially set in the vehicle-mounted device. In a case of a permissible delay time that is variable but has a relatively long period, the permissible delay time may be transmitted separately from the parameters. In a case of a permissible delay time that is variable but has a relatively short period, the permissible delay time may be transmitted simultaneously with the parameters.

The parameters and the permissible delay time transmitted from the server 102 are received by the packet receiver 218 and are output to the buffer-capacity setting unit 220. The buffer-capacity setting unit 220 stores the input parameters. Moreover, the packet transmitter 216 measures the line speed in a normal communicable state, where appropriate, and outputs the line speed to the buffer-capacity setting unit 220. The buffer-capacity setting unit 220 calculates and stores an average value of line speeds input from the packet transmitter 216.

Figure 10:
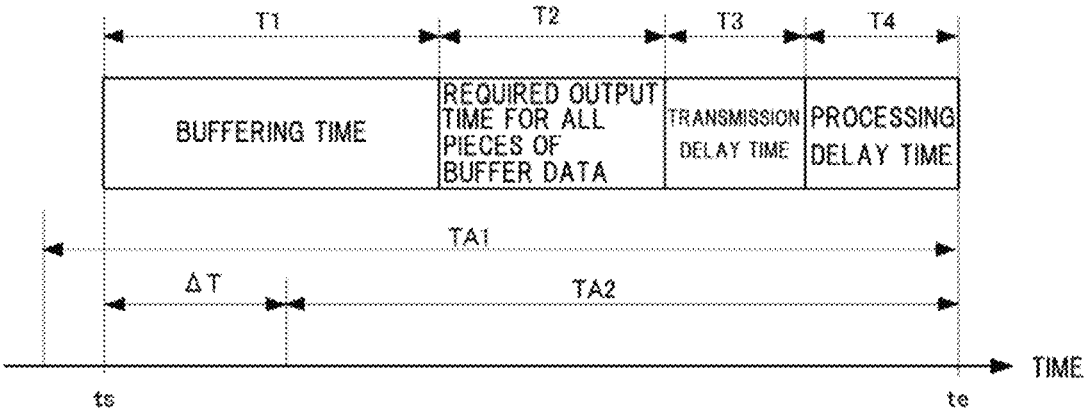
FIG. 10 schematically illustrates parameters for calculating a buffer capacity.

The buffer-capacity setting unit 220 uses the average value of the stored line speeds and the stored parameters to set the buffer capacities of the first buffer 206, the second buffer 208, and the third buffer 210 in the following manner. FIG. 10 illustrates the time required for each process with respect to sensor data of specific real-time-ness (i.e., real-time, semi-real-time, or non-real-time) between a buffer start time point (i.e., a starting time point of a buffering process) is and a processing completion time point (i.e., a time point at which buffer data is received by the server 102 and is completely analyzed) te. In FIG. 10, a buffering time T1 indicates the time required for storing all buffer data B of the specific real-time-ness. Assuming that an amount of sensor data output per unit time from the buffer input controller 202 is defined as S and the data (i.e., the sensor-data acquisition time point and the vehicle location) added to the sensor data is neglected due to being small, B=T1×S. A required output time T2 for all the buffer data indicates the time required from when all the buffer data of the specific real-time-ness is read to when the buffer data is packetized and transmitted from the packet transmitter 216. Specifically, the required output time T2 for all the buffer data is expressed as T2=B/Th=T1×S/Th by using a rate (referred to as "throughput" hereinafter) Th (e.g., in units of bps) for processing the buffer data for each classification (i.e., the sensor data, the sensor-data acquisition time point, and the vehicle location) in the vehicle-mounted device 150. A transmission delay time T3 indicates the time required from when all the buffer data of the specific real-time-ness is transmitted from the vehicle-mounted device 150 to when the buffer data of the specific real-time-ness is received by the server 102. A processing delay time T4 indicates the time required for the server 102 to analyze the sensor data of the specific real-time-ness. Among these time values, the transmission delay time T3 and the processing delay time T4 are measured by the server 102, as mentioned above. On the other hand, the buffering time T1 and the throughput Th are measured in the vehicle-mounted device 150. These time values vary depending on the real-time-ness (i.e., real-time, semi-real-time, or non-real-time). The buffering time T1 increases in the following order: real-time data (i.e., buffer data in the first buffer 206), semi-real-time data (i.e., buffer data in the second buffer 208), and non-real-time data (i.e., buffer data in the third buffer 210). The same applies to the throughput Th, the transmission delay time T3, and the processing delay time T4.

FIG. 10 illustrates two types of permissible delay times TA1 and TA2. For example, the permissible delay time TA1 is related to a service that uses semi-real-time data, and the permissible delay time TA2 is related to a service that uses real-time data. In the case of the permissible delay time TA1, all pieces of data buffered in the vehicle-mounted device 150 may be effectively used by the server 102. In contrast, in the case of the permissible delay time TA2, sensor data buffered in a period ΔT is not effectively used (i.e., is not used in the corresponding service). Specifically, the period ΔT is a wasteful time period. The period ΔT does not directly correspond with a buffer capacity, and is a total of a wasteful buffering time ΔT1 included in T1, an output processing time of data (referred to as "wasteful buffer data" hereinafter) stored during ΔT1 included in T2, a transmission time of the wasteful buffer data included in T3, and a processing time of the wasteful buffer data included in T4. Therefore, assuming that the permissible delay time is TA, an upper limit value ((TA−T3−T4)/(1+S/Th)) for the buffering time T1 may be set such that T1+T2+T3+T4=T1(1+S/Th)+T3+T4≤TA, that is, T1≤(TA−T3−T4)/(1+S/Th). A buffer capacity corresponding to the upper limit value for the buffering time T1 can be calculated as a product of the buffering time T1 and the sensor data amount S per unit time ((TA−T3−T4)×S/(1+S/Th)).

The buffer-capacity setting unit 220 identifies a line speed (quantized data) corresponding to the average value calculated from the line speeds acquired from the packet transmitter 216, among line speeds (quantized data) included in the stored parameters, so as to identify a group of {classification information, transmission delay time, processing delay time} corresponding to the identified line speed (quantized data). Then, the buffer-capacity setting unit 220 identifies single classification information (corresponding to the real-time-ness) in the identified group and substitutes the transmission delay time (T3), the processing delay time (T4), and the permissible delay time (TA) corresponding thereto into (TA−T3−T4)×S/(1+S)Th), so as to calculate an upper limit buffer-capacity value. The buffer-capacity setting unit 220 repeats this process for the number of classification information, so as to set an upper limit buffer-capacity value for each classification information.

The buffer-capacity setting unit 220 outputs the upper limit buffer-capacity value set for each classification information to the buffer input controller 202. In response to this, the buffer input controller 202 preliminarily ensures the buffer capacities of the first buffer 206, the second buffer 208, and the third buffer 210 corresponding to the respective classification information on the memory 128 when shadowing is not occurring, so as to prepare for when shadowing occurs.

The line speed used for calculating each buffer capacity and to be output to the buffer-capacity setting unit 220 from the packet transmitter 216 changes. The line speed when shadowing once occurs and is subsequently resolved can be estimated to be substantially equal to the line speed just before the shadowing occurs. Therefore, the parameters are repeatedly transmitted from the server 102, and the buffer-capacity setting unit 220 sets the upper limit buffer-capacity value by using the average value of the line speeds (i.e., the estimated line-speed value after the shadowing is resolved) acquired from the packet transmitter 216 and calculated every time the parameters are received, so that an appropriate buffer capacity can be ensured for when shadowing occurs. The ensured buffer capacity is an appropriate buffer capacity according to the real-time-ness (i.e., classification information) such that, when data not to be used but to be discarded is transmitted to the server 102, a process for wastefully buffering the data can be suppressed.

The function of the buffer-capacity setting unit 220 in the vehicle-mounted device 150 can be realized by the controller 130 (FIG. 2) reading a predetermined program from the memory 128 and executing the program. For example, the controller 130 may execute the program for realizing the function of the buffer-capacity setting unit 220 concurrently with the program illustrated in FIG. 7.

The above description relates to a case where the average value of line speeds before shadowing occurs is used as the line speed when shadowing once occurs and is subsequently resolved, but the value is not limited thereto. Alternatively, a value estimated using a different method may be used so long as the value is an estimated value of the line speed when the shadowing is resolved. For example, past traveling locations and line speeds corresponding thereto may be stored, and the line speed when the shadowing is resolved may be estimated from the current traveling location of the vehicle.

Functional Configuration of Server

Figure 11:
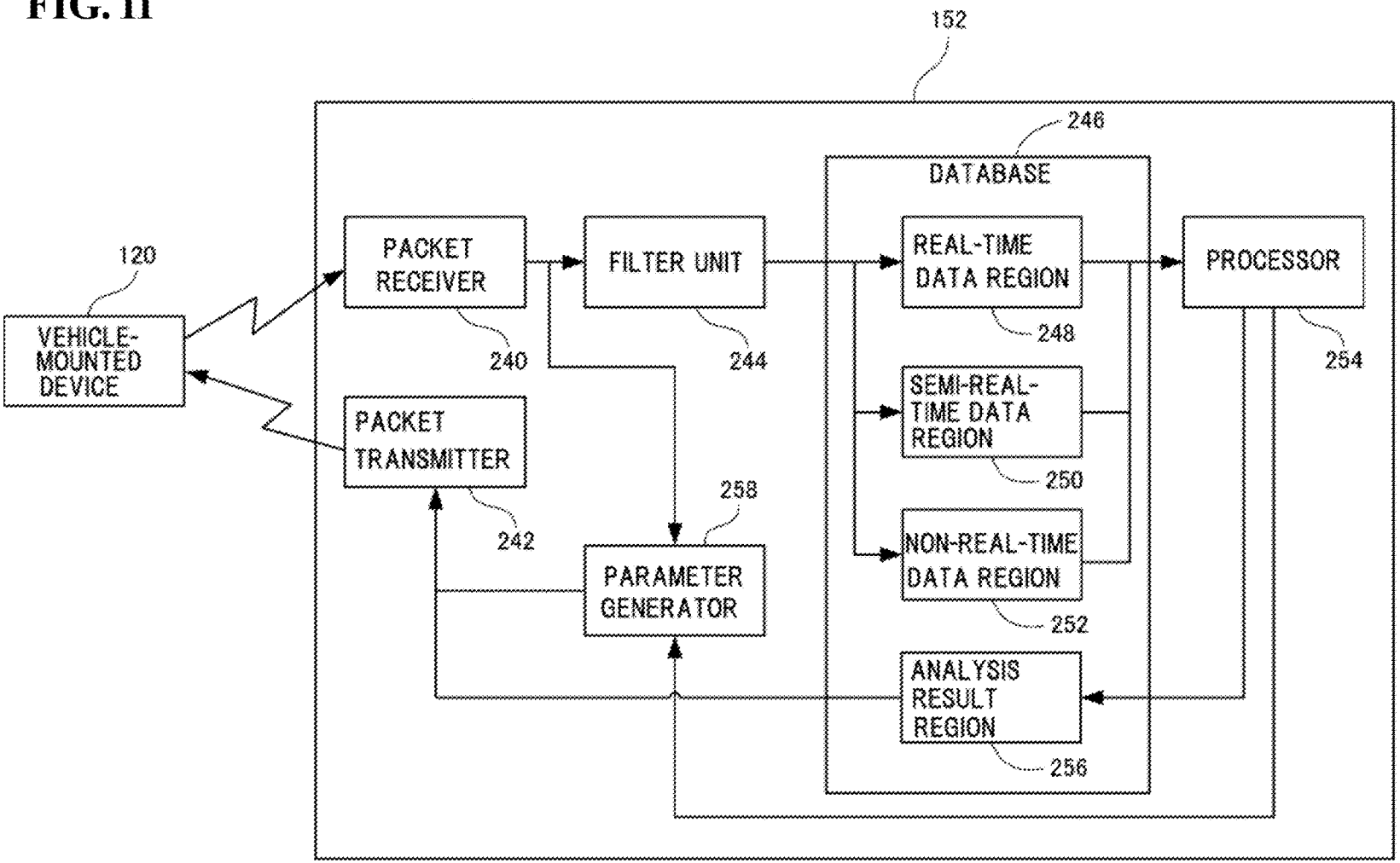
FIG. 11 is a block diagram illustrating a functional configuration of a server according to the first modification of the first embodiment.

A hardware configuration of a server according to the first modification is the same as that in FIG. 3. A functional configuration of a server 152 according to the first modification will now be described with reference to FIG. 11. The configuration of the server 152 is simply different from that of the server 102 in FIG. 6 in that a parameter generator 258 is added thereto. As mentioned above, the parameter generator 258 calculates parameters at the time of concurrent uploading by the vehicle-mounted device 150. In the server 152, components given the same reference signs as the components of the server 102 (FIG. 6) have functions identical to those of the components of the server 102.

Therefore, redundant descriptions will not be repeated. The following description mainly relates to differences.

Similarly to the server 102, the server 152 receives sensor data from a vehicle-mounted device, such as the vehicle-mounted device 150, and an infrastructure sensor, and stores the sensor data in the real-time data region 248, the semi-real-time data region 250, or the non-real-time data region 252 in accordance with the real-time-ness of the received sensor data. Then, the server 152 reads sensor data from the real-time data region 248, the semi-real-time data region 250, and the non-real-time data region 252 in accordance with a service, where appropriate, analyzes the sensor data, and stores the analysis result in the analysis result region 256.

Unlike in the server 102, when the packet receiver 240 in the server 152 receives packet data containing buffered data during concurrent uploading by the vehicle-mounted device 150, the packet receiver 240 outputs the packet data to the parameter generator 258. Moreover, the packet receiver 240 outputs information about the line speed at this time to the parameter generator 258. The parameter generator 258 quantizes and stores the input line speed.

The packet data input to the parameter generator 258 contains sensor data, a sensor-data acquisition time point, a vehicle location, classification information, and a transmission time point. Therefore, the parameter generator 258 can measure (i.e., calculate) a transmission delay time for each classification information. The parameter generator 258 measures the transmission delay time every time it receives packet data, and stores the transmission delay time in correspondence with the relevant classification information. With regard to the transmission delay time, for example, a transmission delay time of each packet is determined for each classification information, and an average value of the determined transmission delay times can be calculated when the concurrent uploading is completed. By repeating this with respect to the packet data transmitted in the concurrent uploading, a group of {classification information, transmission delay time} can be generated for each line speed (i.e., quantized value).

Unlike in the server 102, the processor 254 in the server 152 calculates a processing delay time (i.e., time required for an analysis process) for each type of real-time-ness (i.e., each classification information), associates the processing delay time with the classification information, and outputs the processing delay time to the parameter generator 258. The parameter generator 258 associates the input processing delay time with the classification information to generate a group of {line speed, classification information, transmission delay time, processing delay time}, and transmits the group to the vehicle-mounted device 150 via the packet transmitter 242. Accordingly, every time the vehicle-mounted device 150 receives parameters, the vehicle-mounted device 150 can appropriately set in advance each buffer capacity for storing sensor data for when shadowing occurs, by using the estimated value of the line speed when the shadowing that has occurred is resolved.

The function of the parameter generator 258 can be realized by the controller 140 (FIG. 3) reading a predetermined program from the memory 142 and executing the program. For example, the controller 140 may execute the program for realizing the function of the parameter generator 258 concurrently with the program illustrated in FIG. 8.

Second Modification

The above description relates to a case where a buffering process of sensor data starts when the vehicle-mounted device detects an occurrence of shadowing, but the configuration is not limited thereto. Alternatively, in a second modification, a command for starting a buffering process of sensor data in the vehicle-mounted device is given from the server, and the vehicle-mounted device starts performing the buffering process in accordance with the command. For example, sensor data acquired from a range (referred to as "area") on a road map in which a specific situation, such as a traffic accident, has occurred or from an area outside the detection range of an infrastructure sensor is important for a service (such as a service for providing driving assistance information) provided by the server. Therefore, the server causes the vehicle-mounted device of a vehicle traveling within such an area to buffer sensor data when shadowing occurs.

Figure 4:
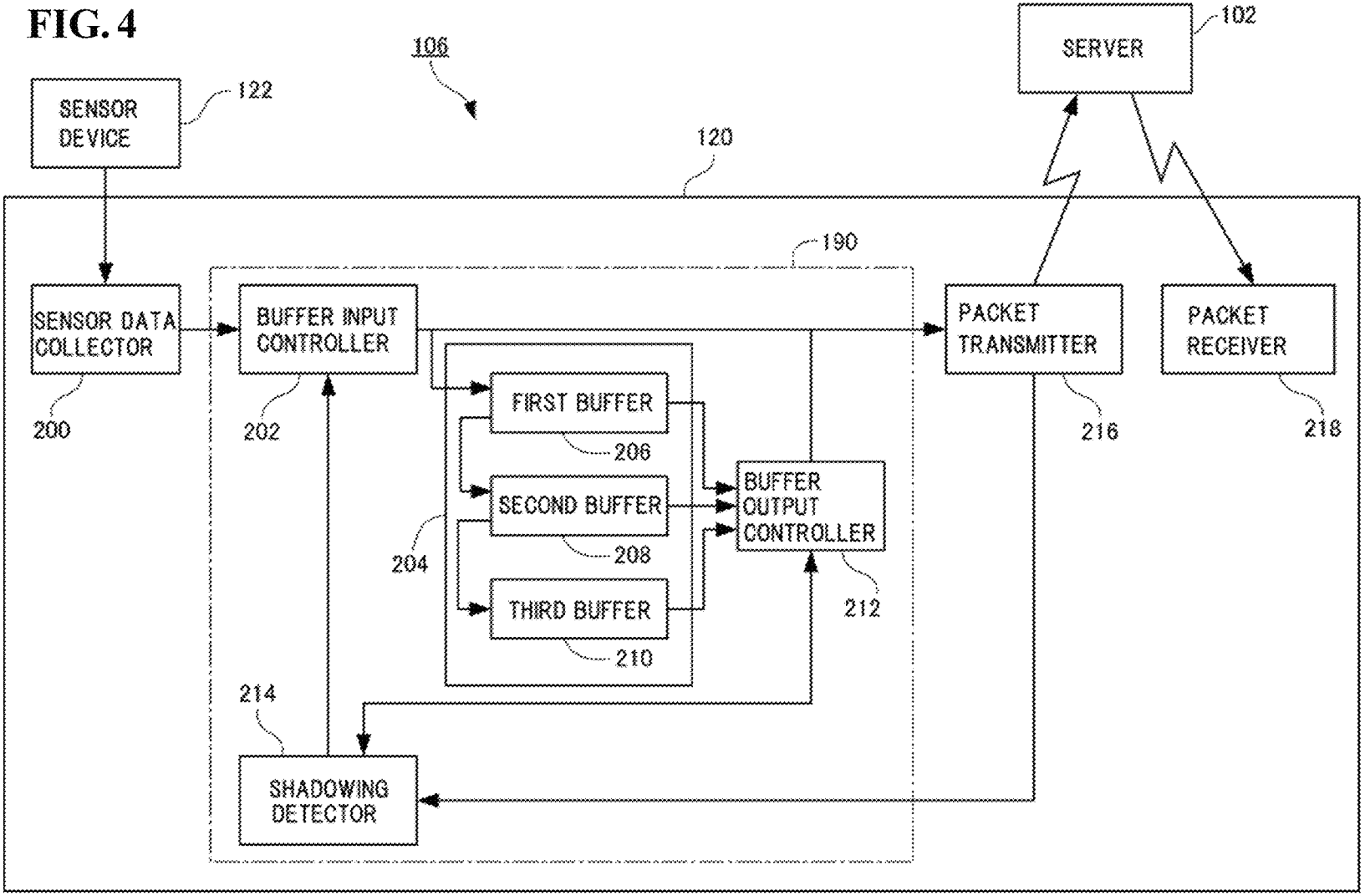
FIG. 4 is a block diagram illustrating a functional configuration of the vehicle-mounted device.

In the second modification, the hardware configuration of the vehicle-mounted device is the same as that in FIG. 2, and the functions of the vehicle-mounted device include the functions illustrated in FIG. 4. However, in addition to detecting shadowing, the shadowing detector 214 also determines whether or not the vehicle is located within an area designated by the server. The hardware configuration of the server is the same as that in FIG. 3, and the functions of the server include the functions illustrated in FIG. 6. Therefore, functions different from those described above will mainly be described with reference to FIG. 2 to FIG. 4 and FIG. 6, where appropriate.

Operation of Vehicle-Mounted Device

Figure 12:
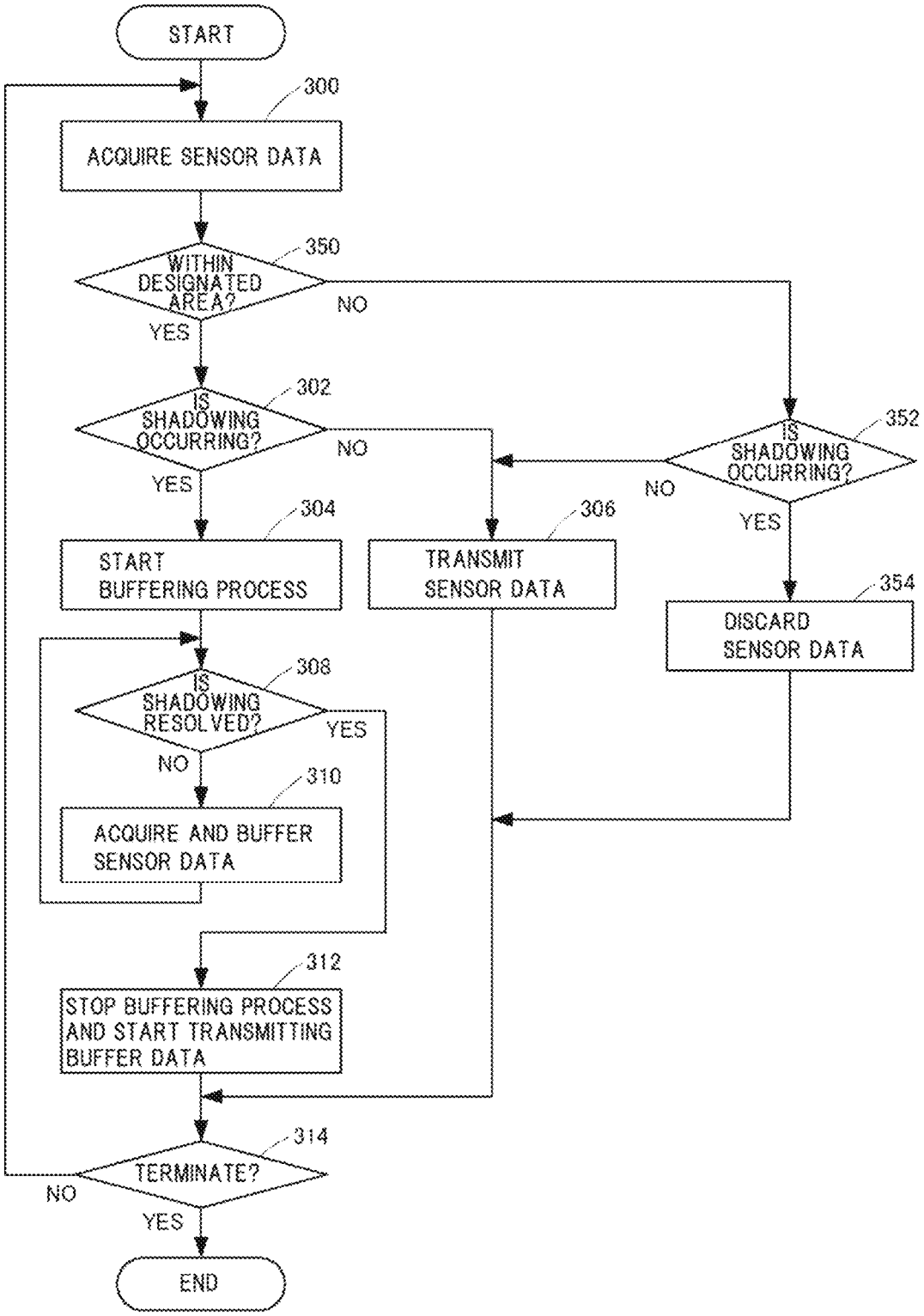
FIG. 12 is a flowchart illustrating the operation of a vehicle-mounted device according to a second modification of the first embodiment.

The vehicle-mounted device according to the second modification executes a process illustrated in a flowchart in FIG. 12 in place of FIG. 7. The flowchart in FIG. 12 is obtained by adding step 350 to step 354 to the flowchart in FIG. 7. In FIG. 12, steps given the same reference numerals as those in FIG. 7 are the same as those in FIG. 7. Therefore, redundant descriptions will not be repeated. The following description mainly relates to differences.

It is assumed that the server 102 transmits information (referred to as "area information" hereinafter) for specifying a predetermined range on a road map to the vehicle-mounted device of each vehicle, and the vehicle-mounted device 120 stores the received area information in the memory 128. In step 350, the controller 130 determines whether or not the vehicle 106 is located within the predetermined range (also referred to as "designated area" hereinafter) specified by the stored area information. If it is determined that the vehicle 106 is located within the designated area, the control proceeds to step 302. Otherwise, the control proceeds to step 352. The determination of whether or not the vehicle 106 is located within the designated area can be performed by using positional information of the vehicle 106 acquired from the GPS.

If it is determined that the vehicle 106 is located within the designated area, step 302 to step 312 are executed. As described above, if shadowing is occurring, the sensor data is buffered during that time. When the shadowing is resolved, concurrent uploading of the buffer data is performed.

In contrast, if it is determined that the vehicle 106 is not located within the designated area, the controller 130 determines in step 352 whether or not shadowing is occurring, similarly to step 302. If it is determined that shadowing is not occurring, the control proceeds to step 306 where the sensor data is transmitted. If it is determined that shadowing is occurring, the control proceeds to step 354. In step 354, the controller 130 discards the sensor data without transmitting or buffering the sensor data.

As described above, if the vehicle 106 is traveling within the designated area, the vehicle-mounted device 120 installed in the vehicle 106 buffers the sensor data while shadowing is occurring, and transmits the buffer data to the server 102 when the shadowing is resolved. If the vehicle 106 is traveling outside the designated area, the vehicle-mounted device 120 installed in the vehicle 106 discards the sensor data if shadowing occurs, and does not retransmit the sensor data or buffer the sensor data. Therefore, the server 102 can acquire sensor data important for a service to be provided, and the vehicle-mounted device 120 can suppress retransmission of sensor data not much important for the server 102.

FIG. 12 relates to a case where it is determined whether or not shadowing is occurring after it is determined whether or not the vehicle 106 is located within the designated area, but the configuration is not limited thereto. Alternatively, for example, it may be determined whether or not shadowing is occurring, and it may be determined whether or not the vehicle 106 is located within the designated area if shadowing is occurring. A condition for starting a buffering process is not limited to a condition in which the vehicle 106 is located within the designated area specified by the area information, and may be a condition different therefrom.

Second Embodiment

State Transition

Figure 14:
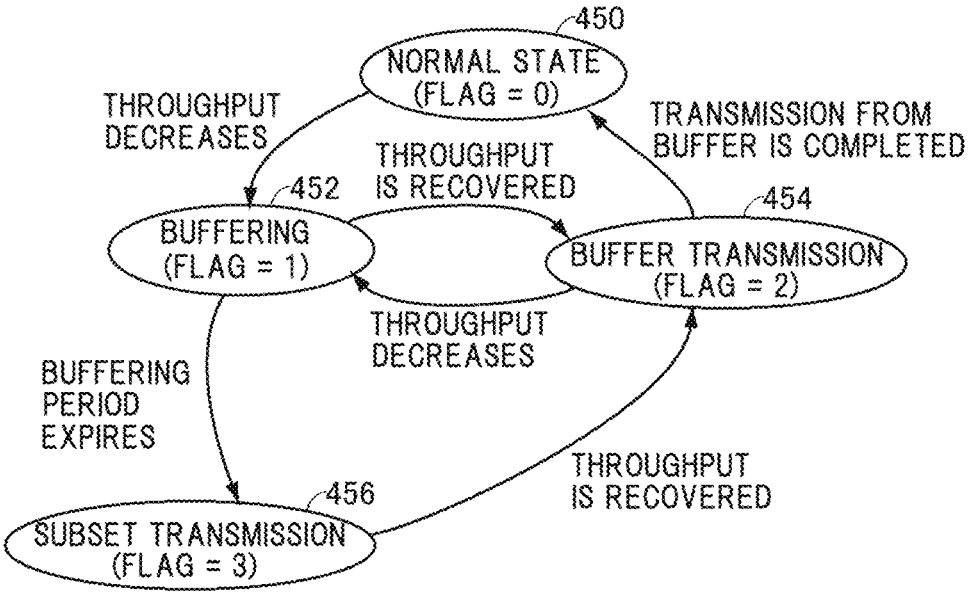
FIG. 14 is a state transition diagram illustrating a change in the state of a vehicle-mounted device according to a second embodiment of the present disclosure.

FIG. 14 illustrates a state transition of a vehicle-mounted device according to a second embodiment of the present disclosure. Referring to FIG. 14, the state of the vehicle-mounted device according to this embodiment includes a normal state 450 involving collecting sensor data and repeating uploading of the sensor data to the server 102, a buffering state 452 involving collecting sensor data and buffering the sensor data without uploading the sensor data to the server 102 and being a state to be transitioned from the normal state 450 when the throughput (i.e., line speed) of uploading to the server 102 from the vehicle-mounted device in the normal state 450 becomes smaller than or equal to a predetermined threshold value, and a buffer transmission state 454 involving sequentially uploading the sensor data buffered in the buffering state 452 to the server 102 if the line speed with respect to the server 102 becomes a value larger than the threshold value when the vehicle-mounted device is in the buffering state 452. When the uploading from the buffers in the buffering state 452 is completed, the state transitions back to the normal state 450. When the throughput becomes smaller than or equal to the threshold value in the buffering state 452, the state transitions back to the buffering state 452.

The above state transition is similar to the case of the first embodiment. The second embodiment further includes a subset transmission state 456 involving converting the buffered data into subsets small enough to be continuously uploadable to the server 102 even with the reduced line speed when the buffering state 452 continues for a predetermined time or longer (i.e., when the buffering period expires), and repeating the uploading of the subsets to the server 102. If the line speed returns to a value larger than the threshold value when the vehicle-mounted device is in the subset transmission state 456, the state of the vehicle-mounted device transitions to the buffer transmission state 454. The state of the vehicle-mounted device changes in accordance with the state of the vehicle-mounted device and a change in the throughput. By appropriately setting the four states of the vehicle-mounted device in advance, the sensor data can be appropriately processed even when, for example, shadowing occurs. By appropriately performing a state transition based on a combination of states in accordance with the transmission throughput, the process for transmitting the sensor data to the external apparatus, the process for accumulating the sensor data in the buffers without transmitting the sensor data to the external apparatus, and the process for transmitting the sensor data accumulated in the buffers to the outside can be executed in a switching manner in accordance with the state transition.

When the line speed decreases in the first embodiment, the vehicle-mounted device interrupts the uploading of the sensor data to the server 102 and buffers the sensor data. When the line speed is recovered, the vehicle-mounted device sequentially uploads the buffered sensor data to the server 102.

However, since there is also a limit to the memory capacity for buffering, the sensor data cannot be buffered any more if the buffering time extends over a long period of time. Although the memory capacity can be ensured by writing over old data, an extremely long period of time where, for example, the sensor data is not uploaded to the server 102 may possibly have an effect on the contents of the service provided by the server 102. In this embodiment, when a predetermined time elapses from when the buffering of sensor data commences, the buffered sensor data is converted into smaller-sized subsets, and the subsets are sequentially uploaded to the server 102. With regard to the buffering period in this case, one method is to estimate the buffering period in accordance with the buffer length of the buffer unit and the sensor data length. The size of each data subset may be fixed, or may be varied in accordance with the usable line speed.

In the second embodiment to be described below, when the state of the vehicle-mounted device transitions from the buffering state 452 to the buffer transmission state 454, the buffering of the sensor data is continuously performed. Furthermore, unlike the first embodiment, in the buffer transmission state 454, the three types of buffered sensor data are uploaded together with the sensor data collected from the sensors simultaneously to the server 102.

The following description relates to, for example, a required configuration and program.

Configuration of Vehicle-Mounted Device

Figure 15:
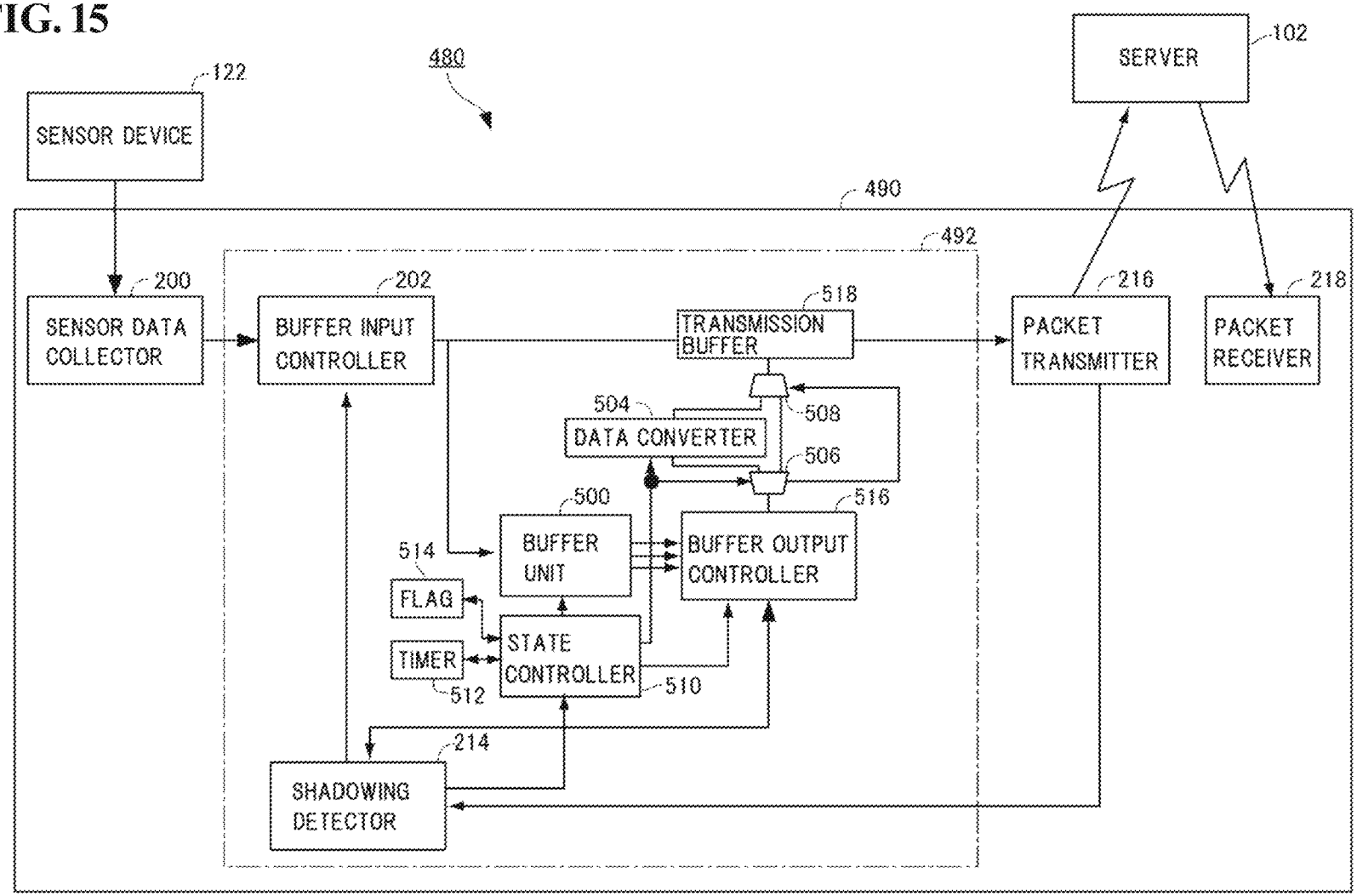
FIG. 15 is a block diagram illustrating a functional configuration of the vehicle-mounted device according to the second embodiment of the present disclosure.

Referring to FIG. 15, a vehicle-mounted device 490 installed in a vehicle 480 according to the second embodiment is obtained by modifying the vehicle-mounted device 150 according to the first embodiment illustrated in FIG. 4. Referring to FIG. 15, the vehicle-mounted device 490 includes a sensor data processor 492 in place of the sensor data processor 190 in FIG. 4. Similarly to the sensor data processor 190, the sensor data processor 492 has a buffering function while performing a process for converting buffered sensor data into data (i.e., data subsets) small enough to be uploadable even at a low line speed and uploading the data to the server 102 via the packet transmitter 216 upon completion of the buffering period.

The sensor data processor 492 includes a buffer unit 500 formed of a ring buffer, in place of the buffer unit 204 in FIG. 4, and is obtained by adding, to the sensor data processor 190 in FIG. 4, a state controller 510 for causing the sensor data processor 492 to transition the state thereof in accordance with FIG. 14 based on the line speed and the buffering period, a flag 514 to be used by the state controller 510 and indicating the state of the sensor data processor 492, a timer 512 to be used by the state controller 510 for measuring the buffering period, and a transmission buffer 518 that is a FIFO (first-in first-out) buffer connected to an output terminal of the buffer input controller 202 and used for temporarily retaining a packet to be supplied to the packet transmitter 216. The buffer unit 500 has a configuration different from that of the buffer unit 204, but the function and the usage method thereof are the same as those of the buffer unit 204, as will be described below.

The sensor data processor 492 further includes, in place of the buffer output controller 212 in FIG. 4, a buffer output controller 516 connected to the state controller 510 and the shadowing detector 214 and provided for reading, from the buffer unit 500, data to be uploaded to the server 102 in accordance with the state transition in FIG. 14, a data converter 504 for converting the sensor data read from the buffer unit 500 by the buffer output controller 516 into data subsets with a smaller data volume in the subset transmission state 456 illustrated in FIG. 14 in response to a control signal supplied from the state controller 510, and selectors 506 and 508 that are both controlled in accordance with a control signal from the state controller 510 and that are provided for selectively supplying an output from the buffer output controller 516 to the transmission buffer 518 in the buffering state 452, for selectively supplying an output from the data converter 504 to the transmission buffer 518 in the subset transmission state 456, and for supplying an output from the buffer output controller 516 to the data converter 504 and supplying converted data to the transmission buffer 518 in the subset transmission state 456.

Figure 16:
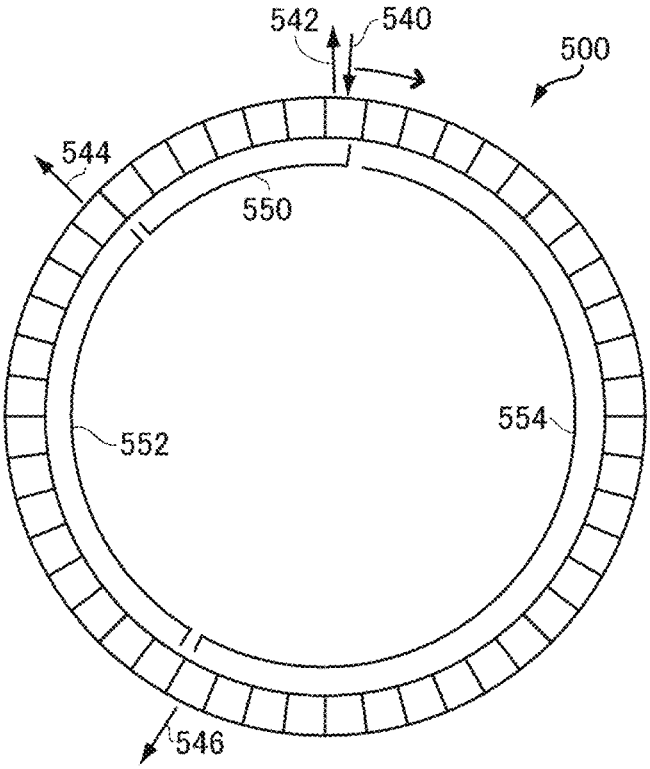
FIG. 16 schematically illustrates a ring buffer used in the vehicle-mounted device according to the second embodiment.

FIG. 16 schematically illustrates the buffer unit 500. The buffer unit 500 is a ring buffer that is a memory in which the foremost address and the rearmost address of the buffer are associated with each other. The buffer unit 500 has a write pointer 540 indicating a write address and a read pointer 542 indicating a read address. Normally, when the buffer unit 500 simply functions as a buffer, data is written to a memory location indicated by the write pointer 540, and the buffer unit 500 advances to a subsequent address. The read pointer 542 points at the trailing end of data existing in the buffer unit 500. When data is to be read from the buffer, the data is read from a memory location indicated by the read pointer 542, and the read pointer 542 advances to a subsequent address.

The buffer unit 500 controls the pointers in this manner such that the read pointer 542 chases after the write pointer 540, whereby the buffer unit 500 can be used as a ring-shaped buffer.

In this embodiment, the direction in which the write pointer 540 advances will be referred to as the front of the write pointer 540, whereas the direction opposite the direction in which the write pointer 540 advances will be referred to as the rear of the write pointer 540. Then, it is conceivable that regions 550, 552, and 554 are arranged at the rear of the write pointer 540 in that order from a position close to the write pointer 540. These regions can be respectively used as the first buffer 206, the second buffer 208, and the third buffer 210 illustrated in FIG. 5.

For reading data from the buffer unit 500, read pointers 542, 544, and 546 are used on the regions 550, 552, and 554, respectively. Each of these pointers indicates the trailing end of the corresponding region in a case where data is fully stored in the region, and indicates a memory location where data is stored in a case where the data exists to an intermediate point of the region. If there is no data in the region, the value of the pointer is set to, for example, null.

Program Configuration of Sensor Data Processor 492

Figure 17:
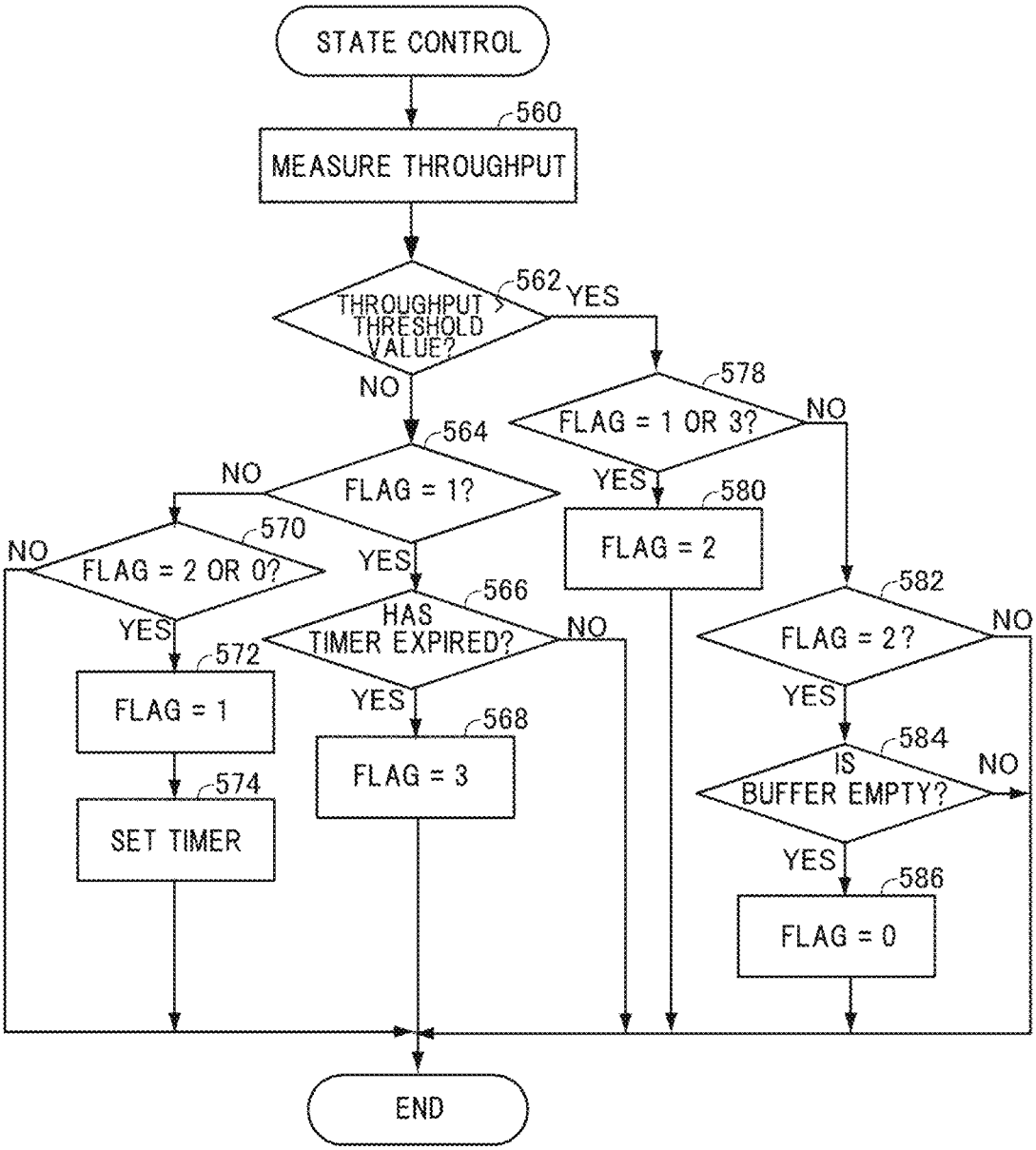
FIG. 17 is a flowchart illustrating a control structure of a program that causes a computer to function as a state controller of the vehicle-mounted device according to the second embodiment.

FIG. 17 illustrates a control structure of a program for causing a computer to control the state of the sensor data processor 492. This program is repeatedly activated at fixed intervals.

Referring to FIG. 17, this program includes step 560 for measuring the throughput with respect to the server 102, step 562 for bifurcating the flow of the control in accordance with whether or not the throughput measured in step 560 is larger than a threshold value, and step 564 for bifurcating the flow of the control in accordance with whether the value of a flag is 1 when the determination result in step 562 is negative.

This program further includes step 570 for determining whether the value of the flag is 2, 0, or another value when the determination result in step 564 is negative and bifurcating the flow of the control in accordance with the determination result, step 572 for setting the flag to 1 when the determination result in step 570 is positive, step 574 for setting the timer to a predetermined buffering period, starting the timer, and terminating the program after step 572, step 566 for determining whether or not the timer started in step 574 has expired when the determination result in step 564 is positive and bifurcating the flow of the control in accordance with the result, and step 568 for setting the flag to 3 and terminating the program when the determination result in step 566 is positive. When the determination result in step 570 is negative and when the determination result in step 566 is negative, this program is terminated.

This program further includes step 578 for determining whether or not the value of the flag is 1 or 3 in response to the determination result in step 562 being positive and bifurcating the flow of the control in accordance with the result, step 580 for setting the flag to 2 and terminating the program when the determination result in step 578 is positive, step 582 for bifurcating the flow of the control in accordance with whether or not the value of the flag is 2 in response to the determination result in step 578 being negative, step 584 for bifurcating the flow of the control in accordance with whether or not the buffer unit 500 is empty in response to the determination result in step 582 being positive, and step 586 for setting the flag to 0 and terminating the program in response to the determination result in step 584 being positive. This program is also terminated when the determination result in step 582 is negative and when the determination result in step 584 is negative.

Figure 18:
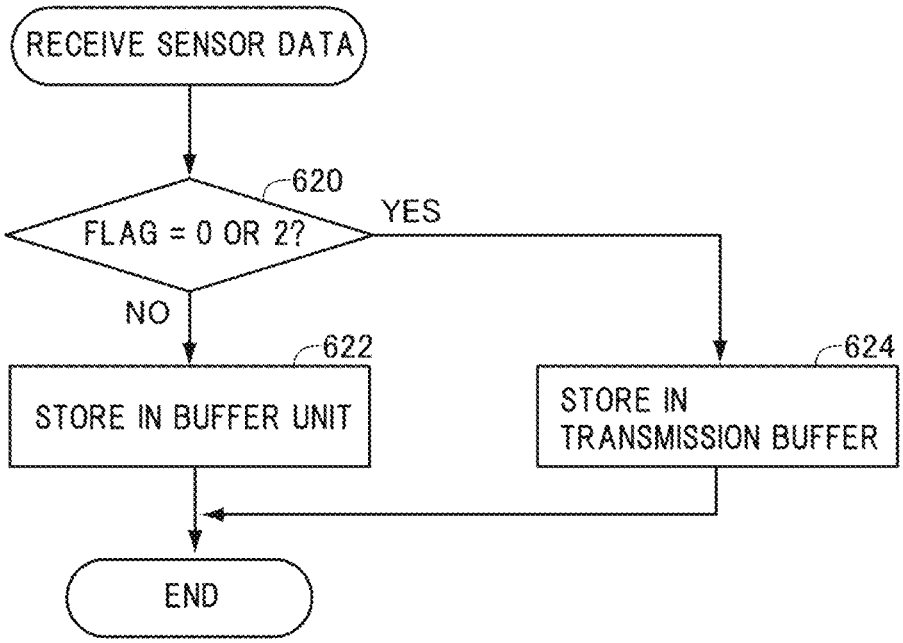
FIG. 18 is a flowchart illustrating a control structure of a program that causes the computer to function as a sensor data collector of the vehicle-mounted device according to the second embodiment.

FIG. 18 illustrates a control structure of a program that causes the computer to function as the buffer input controller 202 in the sensor data processor 492 when the vehicle-mounted device 490 receives sensor data. This program is activated every time sensor data is received. Referring to FIG. 18, this program includes step 620 for determining whether the value of the flag is 0, 2, or another value and bifurcating the flow of the control in accordance with the result, step 624 for storing the received sensor data in the transmission buffer 518 in FIG. 15 and terminating the program when the determination result in step 620 is positive, and step 622 for storing the sensor data in the buffer unit 500 and terminating the process when the determination result in step 620 is negative.

Figure 19:
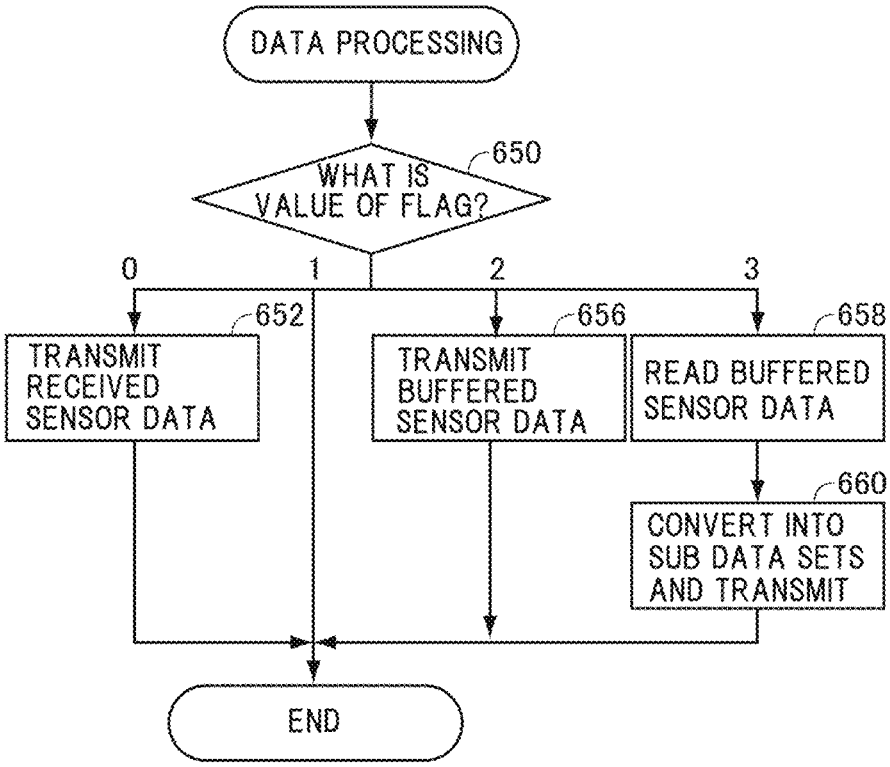
FIG. 19 is a flowchart illustrating a control structure of a program that causes the computer to function as a data processor of the vehicle-mounted device according to the second embodiment.

FIG. 19 illustrates a control structure of a data processing program for causing the computer to operate such that the sensor data processor 492 reads appropriate data in accordance with any of the states illustrated in FIG. 14 based on the data stored in the buffer unit 500 and the transmission buffer 518, generates a packet, and supplies the packet to the packet transmitter 216. This program is repeatedly activated at fixed intervals.

Referring to FIG. 19, this program includes step 650 for bifurcating the flow of the control in accordance with whether the value of the flag is any one of 0, 1, 2, and 3, step 652 for reading the received sensor data from the transmission buffer 518 and packetizing the sensor data when the value of the flag is 0, uploading the packetized sensor data to the server 102 via the packet transmitter 216, and terminating the program, step 656 for concurrently reading pieces of data (i.e., three types at maximum) buffered in the buffer unit 500 when the value of the flag is 2, packetizing the data, and uploading the packetized data to the server 102, step 658 for concurrently reading pieces of data (i.e., three types at maximum) buffered in the buffer unit 500 when the value of the flag is 3, and step 660 for converting the data read in step 658 into smaller-sized subsets, packetizing the subsets, uploading the packetized subsets to the server 102, and terminating the program. Nothing is to be processed in this program when the value of the flag is 1.

Operation of Vehicle-Mounted Device 490

The vehicle-mounted device 490 operates as follows.

It is assumed that the flag is 0 (in a normal state) at the time of activation of the vehicle-mounted device 490.

Normal State

Referring to FIG. 15, in the normal state, the sensor data collector 200 collects sensor data from the sensor device 122 and supplies the sensor data to the buffer input controller 202. When the buffer input controller 202 receives the sensor data, the buffer input controller 202 supplies the sensor data to the transmission buffer 518. The packet transmitter 216 reads the sensor data from the transmission buffer 518, packetizes the sensor data, and uploads the packetized sensor data to the server 102.

When shadowing occurs and causes the throughput between the packet transmitter 216 and the server 102 to decrease to a value smaller than or equal to the threshold value, the state transitions to the buffering state 452, as illustrated in FIG. 14. Specifically, when the shadowing detector 214 detects an occurrence of shadowing based on data from the packet transmitter 216, the shadowing detector 214 supplies the information to the state controller 510. In response to this signal, the state controller 510 rewrites the value of the flag 514 to 1, and starts the timer 512.

From the viewpoint of the above process with reference to the flow of a program, when the program in FIG. 18 is activated, the determination result in step 620 is positive, so that step 624 is executed. When the program illustrated in FIG. 19 is activated, the control proceeds to step 652 in accordance with the determination result in step 650. In step 652, the sensor data stored in the transmission buffer 518 is read by the packet transmitter 216 and is uploaded to the server 102. When the program in FIG. 17 is activated, the throughput is measured in step 560, and the determination result in step 562 subsequently becomes negative. Since the determination result in step 564 is negative, the determination process in step 570 is performed. The determination result in step 570 becomes positive, the flag is set to 1 in step 572, and the timer is started in step 574.

Buffering State

In the buffering state 452, the vehicle-mounted device 490 operates as follows. Referring to FIG. 15, when the buffer input controller 202 receives sensor data from the sensor data collector 200, the buffer input controller 202 stores the sensor data at a write position in the buffer unit 500, and increments the write pointer 540 by one. This state continues unless the throughput increases. If the throughput increases before the timer 512 expires, the state of the sensor data processor 492 transitions to the buffer transmission state 454. If the timer 512 expires while still in the buffering state 452, the buffering state 452 transitions to the subset transmission state 456.

From the viewpoint of the above process with reference to the flow of a program, when the program in FIG. 17 is activated, step 562, step 564, and step 566 are executed if the throughput measured in step 560 is smaller than or equal to the threshold value. Step 568 is not to be executed until the timer expires. When the timer expires, step 568 is executed. This process is repeated. On the other hand, every time the program illustrated in FIG. 18 is executed, the control proceeds from step 620 to step 622 where the sensor data is stored in the buffer unit 500. This process is repeated. Moreover, even if the program illustrated in FIG. 19 is executed, nothing is to be processed since the flag is 1. The data is simply accumulated in the buffer unit 500.

In contrast, when the throughput becomes larger than the threshold value before the timer expires, the determination result in step 562 becomes positive in the program in FIG. 17, and step 578 and step 580 are executed, so that the flag is set to 2. Specifically, the state of the sensor data processor 492 transitions to the buffer transmission state 454.

Furthermore, when the timer 512 expires before the throughput increases, step 560, step 562, and step 564 are executed in the program in FIG. 17, and the determination result in step 566 becomes positive. As a result, step 568 is executed, so that the flag is set to 3. Specifically, the state of the sensor data processor 492 transitions to the subset transmission state 456 (FIG. 14).

Buffer Transmission State

In the buffer transmission state 454, the buffer output controller 516 illustrated in FIG. 15 reads the rearmost (i.e., the oldest) sensor data (if any) from the regions 550, 552, and 554 of the buffer unit 500, and concurrently supplies the sensor data to the transmission buffer 518. On the other hand, the buffer input controller 202 stops the buffering of sensor data to the buffer unit 500 and transmits data to the transmission buffer 518. The packet transmitter 216 sequentially reads both sensor data stored in the transmission buffer 518 (i.e., sensor data from the buffer input controller 202 and sensor data from the buffer unit 500), packetizes the sensor data, and uploads the packetized sensor data to the server 102. When the uploading from the buffer is completed, the state transitions back to the normal state 450.

The following description is from the viewpoint of the above process with reference to the flow of a program. When the flag is set to 2, if a state where the throughput is larger than the threshold value continues during the execution of the program in FIG. 17, step 560, step 562, step 578, step 582, and step 584 are executed in that order. When it is determined in step 584 that the buffer unit 500 is not empty, the program is terminated. When it is determined that the buffer unit 500 is empty, the flag is set to 0. Specifically, in this case, the sensor data processor 492 returns to the normal state 450.

If the throughput becomes smaller than or equal to the threshold value again before the buffer unit 500 becomes empty and the program in FIG. 17 is executed immediately thereafter, step 560, step 562, step 564, step 570, step 572, and step 574 are executed in that order. As a result, the flag is set to 1 (i.e., the state of the sensor data processor 492 transitions back to the buffering state 452), and the timer starts.

Subset Transmission State

In the subset transmission state 456, the sensor data processor 492 illustrated in FIG. 15 operates as follows. The buffer input controller 202 stores sensor data in the buffer unit 500. Similarly to when in the buffering state 452, the buffer output controller 516 concurrently reads a maximum of three types of sensor data from the buffer unit 500 and supplies the sensor data to the selector 506. In the subset transmission state 456, the selector 506 supplies the sensor data to the data converter 504. The data converter 504 converts the sensor data into smaller-sized data subsets, and supplies the data subsets to the selector 508. The selector 508 stores the data subsets in the transmission buffer 518. The packet transmitter 216 reads the data subsets from the transmission buffer 518, packetizes the data subsets, and uploads the packetized data subsets to the server 102.

In this state, the data subsets that are smaller-sized than the sensor data are uploaded to the server 102, so that the sensor data can be uploaded from the vehicle-mounted device 490 to the server 102 even if the throughput is low. Needless to say, since the uploadable data size is limited, only useful data for the server 102 is selected as a data subset.

When the throughput becomes larger than the threshold value in this state, the state of the sensor data processor 492 transitions to the buffer transmission state 454, so that the buffered sensor data is directly uploaded.

The operation of the sensor data processor 492 in the subset transmission state 456 is as follows from the viewpoint of a program. The flag is 3. Unless the throughput increases, step 560, step 562, step 564, and step 570 are executed in this order every time the program illustrated in FIG. 17 is executed. Because the flag is 3, the determination result in step 570 is negative, and the value of the flag does not change. When the throughput increases and becomes larger than the threshold value in mid-course, step 560, step 562, step 578, and step 580 are executed, the flag is set to 2, and the state of the sensor data processor 492 transitions to the buffer transmission state 454.

On the other hand, while the value of the flag is 3, step 620 and step 622 are executed every time the program in FIG. 18 is executed. In step 622, the sensor data is stored in the buffer unit 500. Likewise, the program in FIG. 19 is repeatedly executed. Every time the program is executed, step 650, step 658, and step 660 are executed, so that the sensor data read from the buffer unit 500 is converted into data subsets and uploaded to the server 102.

When the flag changes to 2, step 620 and step 624 are executed in the program in FIG. 18, so that new sensor data is stored in the transmission buffer 518. In the program in FIG. 19, step 650 and step 656 are executed, so that the sensor data is read from the buffer unit 500 and is uploaded to the server 102. As a result, the buffered data is used by the server 102 without being wasted, whereby the server 102 can provide a more satisfactory service.

As described above, in the vehicle-mounted device 490 according to this embodiment, when the buffering state continues for a predetermined time or longer, the state changes from the buffering state 452 to the subset transmission state 456. In the subset transmission state 456, new sensor data is added to the buffer unit 500, whereas data previously accumulated in the buffer unit 500 is read therefrom, is converted into data subsets with a smaller data size, and is uploaded to the server 102. Since a portion of the sensor data in the vehicle-mounted device 490 can be continuously uploaded to the server 102, the server 102 can incorporate the data of the vehicle equipped with the vehicle-mounted device 490 into the service. As a result, the service provided by the server 102 can be increased in quality.

Modifications

Figure 20:
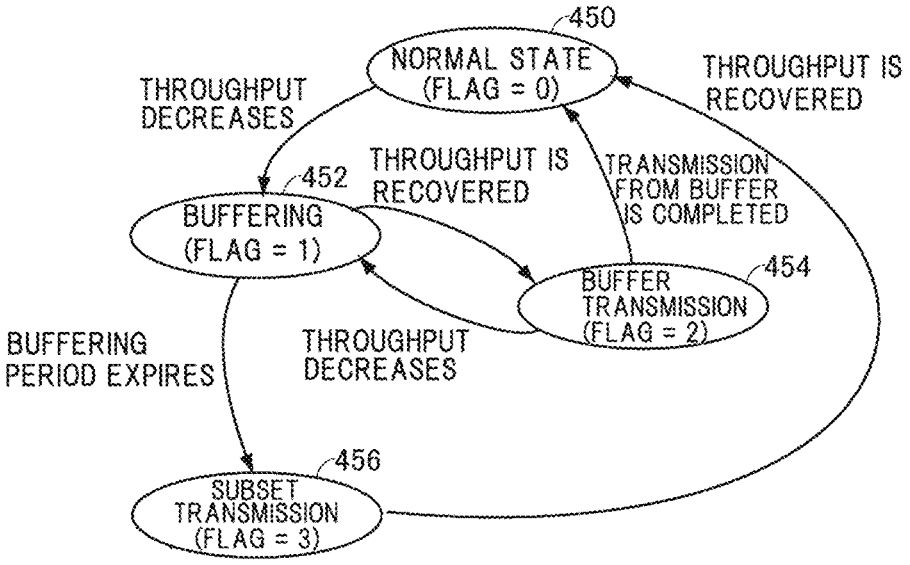
FIG. 20 is a state transition diagram illustrating a change in the state of a vehicle-mounted device according to a third embodiment of the present disclosure.

In the second embodiment described above, when the buffering state 452 continues for a predetermined time or longer, the state of the vehicle-mounted device is changed from the buffering state 452 to the subset transmission state 456. Then, unless the throughput increases, this subset transmission state 456 is maintained. When the throughput increases, the state is transitioned from the subset transmission state 456 to the buffer transmission state 454. However, the embodiment of the present disclosure is not limited to this mode. For example, as illustrated in FIG. 20, another conceivable embodiment involves immediately transitioning the state to the normal state 450 when the throughput becomes larger than the threshold value during the subset transmission state 456. Accordingly, real-time data can be transmitted to the server 102, so that the server 102 can provide a more satisfactory service. In this case, the sensor data accumulated in the buffer unit 500 is to be entirely discarded together with the transition from the subset transmission state 456 to the normal state 450. In other words, the buffer unit 500 is cleared. Although the discarding of the data may possibly have a slight effect on the processing in the server 102, the effect decreases over time, and eventually disappears. On the other hand, by clearing the buffer unit 500, the buffer unit 500 can be used again when shadowing occurs.

Furthermore, in the above embodiment, only one subset transmission state 456 is employed. However, the present disclosure is not limited to such an embodiment. A plurality of levels of states like the subset transmission state 456 may be provided in accordance with the throughput, and the transition may be made between the states. As already mentioned above, when sensor data is to be converted into smaller-sized data subsets, the size of each data subset may increase with increasing communication throughput and decrease with decreasing communication throughput. Specifically, the ratio of the data size after the conversion to the data size before the conversion is a monotonically increasing function relative to the throughput. The transmissible data size decreases with decreasing throughput. Therefore, by determining the data size after the conversion using the monotonically increasing function relative to the throughput, sensor data with a data size corresponding to the degree of the throughput can be transmitted seamlessly to an external apparatus.

Computer-Based Implementation

Figure 21:
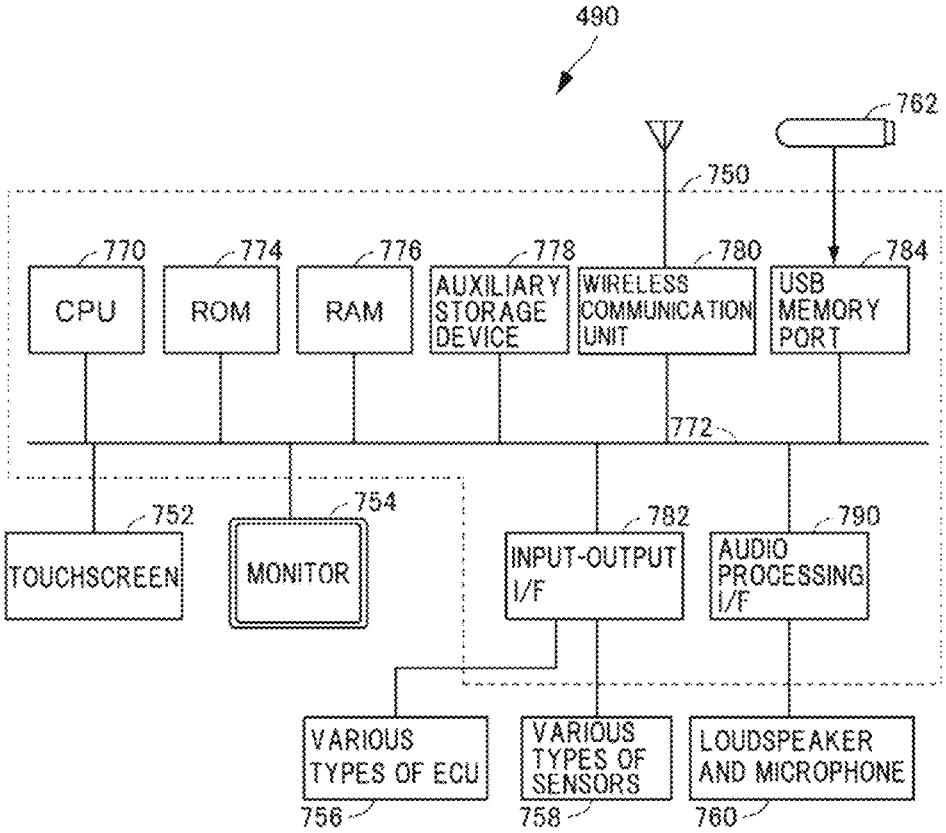
FIG. 21 is a block diagram illustrating a hardware configuration of a computer that realizes the vehicle-mounted device according to the second embodiment of the present disclosure and a modification thereof.

Referring to FIG. 21, the vehicle-mounted device 490 is substantially a processor including a computer 750, and includes a CPU (central processing unit) 770 and a bus 772 that is a transmission path for transmitting data and commands between the CPU 770 and the components of the computer 750. The computer 750 further includes a ROM (read-only memory) 774, a RAM (random access memory) 776, a nonvolatile auxiliary storage device 778, such as a hard disk or an SSD (solid state drive), a wireless communication unit 780 that provides communication with the outside by wireless communication, an input-output interface (I/F) 782, an audio processing I/F 790 for providing an audio-based interaction with a user, and a USB memory port 784 to and from which a USB memory 762 is attachable and detachable and that enables communication between the USB memory 762 and other components in the computer 750. All of the above components are connected to the bus 772.

The vehicle-mounted device 490 further includes a touch-screen 752, a monitor 754 such as a liquid crystal monitor including a display control device, various types of ECUs 756 and various types of sensors 758, such as a LiDAR, which are connected to the input-output I/F 782 and are provided for controlling the vehicle, and a loudspeaker and microphone 760 connected to the audio processing I/F 790. These components are connected to the bus 772. The ROM 774 stores, for example, an activation program for the computer 750. The RAM 776 is used as a work area for storing various variables to be used when the CPU 770 performs processing.

For example, the programs having the control structures illustrated in FIG. 17 to FIG. 19 are distributed by being stored in the USB memory 762 in FIG. 21, and are executed by the CPU 770 by being forwarded thereto by the auxiliary storage device 778. When each of these programs is to be executed, the program is loaded to the RAM 776 from the USB memory 762 via the USB memory port 784 and the bus 772. Alternatively, the program is loaded to the RAM 776 from the auxiliary storage device 778 via the bus 772. It is also possible to store the program in the auxiliary storage device 778 from the USB memory 762 via the USB memory port 784.

The above embodiments and modifications relate to a case where a trigger for starting a buffering process is when shadowing occurs or when a condition instructed from the server is satisfied, but are not limited thereto. Alternatively, the vehicle-mounted device may constantly buffer sensor data. Specifically, when the vehicle-mounted device acquires sensor data, the vehicle-mounted device buffers the sensor data simultaneously with transmission of the sensor data to the server. Then, when the shadowing that has occurred is resolved or when the condition instructed from the server is no longer satisfied, the vehicle-mounted device may stop the transmission of the sensor data and start transmitting the buffered data.

Figure 13:
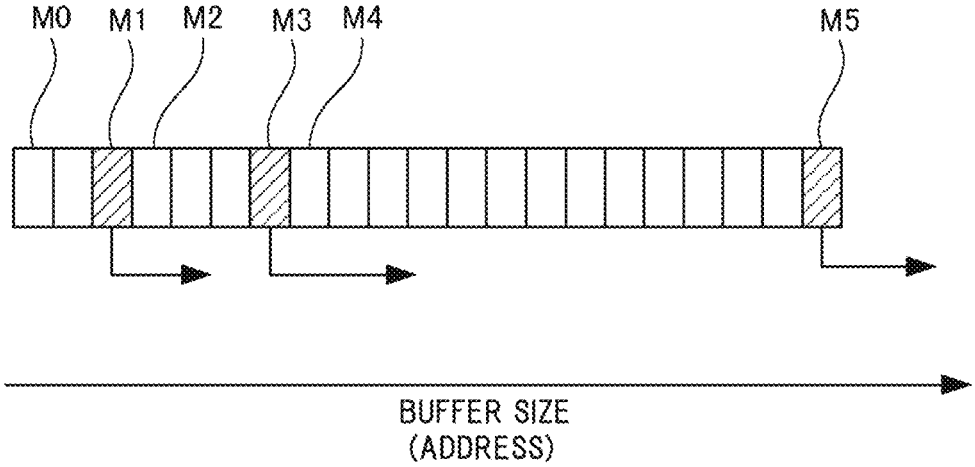
FIG. 13 is a block diagram illustrating the configuration of a buffer different from those in FIG. 5.

The above description relates to a case where the vehicle-mounted device ensures a plurality of buffer regions on a memory in accordance with permissible delay times demanded by a service, but the configuration is not limited thereto. Alternatively, for example, as illustrated in FIG. 13, a single buffer region may be allocated to consecutive addresses. In FIG. 13, a data region of addresses M0 to M1, a data region of addresses M2 to M3, and a data region of addresses M4 to M5 respectively correspond to the first buffer 206, the second buffer 208, and the third buffer 210 in FIG. 5. Specifically, in the buffering process, sensor data is written in the address M0. After shifting the stored data rightward, subsequent data is written in the address M0. Data stored in the address M5 is discarded (i.e., data to the left of the address M5 is written over the address M5) before subsequent data is to be written in the address M0. During concurrent uploading, for example, the addresses M1, M3, and M5 represent read start addresses, and pieces of data at addresses to the left of these addresses are sequentially read in accordance with the aforementioned priority levels.

The above description relates to a case where three types of buffers are provided with respect to a single sensor, but the configuration is not limited thereto. Alternatively, in a case where the vehicle includes a plurality of sensors, the vehicle-mounted device may include three types of buffers for each sensor. In that case, even when the buffer unit 204 (FIG. 4) is provided for each sensor, a single buffer output controller 212 may set the priority levels of the individual buffers and perform concurrent uploading in view of the real-time-ness among the plurality of sensors.

The above description relates to a case where three types of buffers are provided in accordance with the real-time-ness of sensor data, but the configuration is not limited thereto. Alternatively, two types of buffers may be provided or four or more types of buffers may be provided in accordance with the real-time-ness of sensor data.

The above description relates to a case where classification information indicating a delay time is added to buffer data when the buffer data is to be transmitted, but the configuration is not limited thereto. Although the addition of classification information facilitates the classification of sensor data in the server, since sensor-data acquisition information is added to the sensor data, if the sensor-data acquisition information is to be used for determining the real-time-ness, the classification information does not have to be added. For example, by matching the clock in the vehicle-mounted device with the clock in the server, the server can compare the current time point with the sensor-data acquisition time point of the received sensor data to determine the real-time-ness of the received sensor data, and can store the sensor data in the corresponding region (e.g., any one of the real-time data region 248, the semi-real-time data region 250, and the non-real-time data region 252 in FIG. 6).

The above embodiment relates to, but is not limited to, a case where, while buffer data is being transmitted as a result of the buffer input controller 202 receiving a transmission start command from the shadowing detector 214 when shadowing is resolved, the transmission of sensor data output from the sensor data collector 200 is interrupted. Alternatively, the sensor data output from the sensor data collector 200 may be transmitted while the buffer data is being transmitted. In order to achieve this, the shadowing detector 214 may simply not output a transmission start command to the buffer input controller 202 when shadowing is resolved. In order to transmit both the sensor data output from the sensor data collector 200 and the buffered sensor data, the timings for outputting the data to the packet transmitter 216 may be adjusted between the buffer input controller 202 and the buffer output controller 212.

Similarly to the description related to FIG. 4, the functions of the buffer input controller 202, the buffer unit 204, the buffer output controller 212, the shadowing detector 214, and the buffer-capacity setting unit 220 surrounded by the single-dot chain line in FIG. 9 may also be realized by one or more semiconductor integrated circuits, which may be installed in the vehicle-mounted device 150 as separate components from the controller 130 and the memory 128 (see FIG. 2).

The first modification described above relates to a case where the server calculates a transmission delay time for each type of real-time-ness (i.e., for each category information), but the configuration is not limited thereto. Alternatively, the vehicle-mounted device may calculate the transmission delay time. For example, when the server receives packet data containing category information, the server may transmit the reception time point thereof to the vehicle-mounted device. The vehicle-mounted device may store the transmission time point of the corresponding packet data and the data size (of, for example, the sensor data) contained in the packet, so that the vehicle-mounted device can calculate the transmission delay time for each type of real-time-ness (i.e., for each category information) by using the reception time point at which the transmitted packet data is received by the server. Moreover, the vehicle-mounted device can quantize the line speed at the time of concurrent uploading and store the quantized line speed. Therefore, in this case, the vehicle-mounted device can set an appropriate buffer capacity with respect to each buffer by receiving, from the server, the processing delay time and the permissible delay time for each type of real-time-ness (i.e., for each category information).

The above description relates to a case where classification information is not to be added to sensor data transmitted from an infrastructure sensor, that is, a case where shadowing does not occur with respect to an infrastructure sensor, but the configuration is not limited thereto. Even in a case of a fixedly-installed infrastructure sensor, a transmission radio wave from the antenna thereof may be intercepted by a vehicle traveling in the vicinity thereof, thus possibly causing shadowing to occur. Therefore, similarly to a vehicle-mounted device, an infrastructure sensor may include a plurality of types of buffers in accordance with delay times, and may buffer sensor data when shadowing occurs, add classification information to the buffer data when the shadowing is resolved, and concurrently upload the data while giving priority to data with a shorter delay time. Accordingly, the server 102 can effectively use the sensor data received from the infrastructure sensor.

Furthermore, in the subset transmission state 456 according to the second embodiment described above, the data converter 504 converts sensor data into smaller-sized data subsets and transmits the data subsets to the server 102. However, the present disclosure is not limited to such an embodiment. For example, data sets of sensor data to be taken into the sensor data collector 200 from the sensor device 122 may be limited only to a portion of the data sets. For example, the data to be selected may be set in accordance with priority ranks set in advance, or may be set in accordance with a command from the server 102 when communication with the server 102 is possible. Accordingly, even when the line speed with the server 102 is slow, minimal sensor data can be transmitted to the server 102 and be reflected on the driving assistance by the server 102.

Although the present disclosure has been described above with reference to the description of the embodiments, the above embodiments are exemplary, and the present disclosure is not to be limited to the above embodiments. The scope of the present disclosure is indicated by the individual claims together with reference to the detailed description of the disclosure, and includes all changes within the meaning and scope equivalent to the wording used in the claims.

REFERENCE SIGNS LIST

100 driving assistance system
102, 152 server
104 base station
106, 430, 480 vehicle
108 network
110 detection target
120, 150, 490 vehicle-mounted device
122 sensor device
124 I/F unit
126, 144 communication unit
128, 142 memory
130, 140 controller
132, 146 bus
190, 440, 492 sensor data processor
200 sensor data collector
202 buffer input controller
204 buffer unit
206 first buffer
208 second buffer
210 third buffer
212 buffer output controller
214 shadowing detector
216, 242 packet transmitter
218, 240 packet receiver
220 buffer-capacity setting unit
244 filter unit
246 database
248 real-time data region
250 semi-real-time data region
252 non-real-time data region
254 processor
256 analysis result region
258 parameter generator
450 normal state
452 buffering state
454 buffer transmission state
456 subset transmission state
500 buffer unit
504 data converter
506, 508 selector
510 state controller
512 timer
514 flag
516 buffer output controller
518 transmission buffer
540 write pointer
542, 544, 546 read pointer
550, 552, 554 region
300, 302, 304, 306, 308, 310, 312, 314, 350, 352, 354, 400, 402, 404, 406, 408, 410, 412, 414, 416, 560, 562, 564, 566, 568, 570, 572, 574, 578, 580, 582, 584, 586, 620, 622, 624, 650, 652, 656, 658, 660 step
750 computer
752 touchscreen
754 monitor
756 various types of ECUs
758 various types of sensors
760 loudspeaker and microphone
762 USB memory
770 CPU
772 bus
774 ROM
776 RAM
778 auxiliary storage device
780 wireless communication unit
782 input-output I/F
784 USB memory port
790 audio processing I/F
T1 buffering time
T2 required output time for all buffer data T3 transmission delay time
T4 processing delay time
TA1, TA2 permissible delay time
ts buffer start time point
te processing completion time point
M0, M1, M2, M3, M4, M5 address

The invention claimed is:

1. A vehicle-mounted device installed in a vehicle, the vehicle-mounted device comprising:

circuitry configured to collect sensor data detected by a sensor with which the vehicle is equipped;

a transmitter configured to transmit the sensor data to an external apparatus;

buffer memory configured to store the sensor data, wherein the circuitry is configured to determine whether a predetermined condition is satisfied;

control transmission of the sensor data by the transmitter to the external apparatus;

cause the transmitter to stop transmitting the sensor data to the external apparatus when it is determined that the predetermined condition is satisfied; and cause, when a result of the determination changes to indicate that the predetermined condition is not satisfied after it has been determined that the predetermined condition is satisfied, the transmitter to concurrently transmit the sensor data stored in the buffer memory to the external apparatus while giving priority to sensor data with a shorter delay time based on priority levels according to delay times, the delay times each representing a difference between an acquisition time point of the sensor data and a current time point, wherein the predetermined condition includes a state where the vehicle is located within a predetermined range on a road map specified by area information received from the external apparatus and an occurrence of a phenomenon in which communication with the external apparatus is not possible, wherein if the predetermined condition includes the occurrence of the phenomenon, the circuitry is configured to determine that the predetermined condition is satisfied if the phenomenon has occurred, and determine that the predetermined condition is not satisfied if the phenomenon has not occurred; and a receiver configured to receive a plurality of permissible delay times from the external apparatus that performs a plurality of processes, each permissible delay time representing an upper limit for a difference between the acquisition time point of the sensor data to be processed and a time point for executing a corresponding process in the plurality of processes, wherein the buffer memory includes a plurality of buffers individually having capacities set for the plurality of permissible delay times for storing the sensor data to be processed in the plurality of processes, the receiver is configured to receive a transmission delay time and a processing delay time from the external apparatus, the transmission delay time being a time from when the sensor data corresponding to each permissible delay time is transmitted from the vehicle-mounted device to when the sensor data is received by the external apparatus, the processing delay time being a time spent from when the sensor data corresponding to each permissible delay time starts to undergo the process to when the sensor data has completely undergone the process, and the circuitry is configured to predict a line speed of a communication line when the transmitter concurrently transmits the sensor data; and change each of the capacities of the plurality of buffers to a value set in accordance with the predicted line speed, the permissible delay time, the transmission delay time, the processing delay time, and a throughput, the throughput being a processing rate from when sensor data corresponding to the respective permissible delay times is read from the plurality of buffers to when the sensor data is transmitted when the transmitter concurrently transmits the sensor data.

2. The vehicle-mounted device according to claim 1, wherein if the predetermined condition includes the state where the vehicle is located within the predetermined range and the occurrence of the phenomenon in which communication with the external apparatus is not possible, the circuitry is configured to determine that the predetermined condition is satisfied if the vehicle is located within the predetermined range and the phenomenon has occurred, and determine that the predetermined condition is not satisfied if the vehicle is located outside the predetermined range or the phenomenon has not occurred.

3. The vehicle-mounted device according to claim 2, wherein each delay time is classified into any one of a plurality of classifications in accordance with length of the delay time, and when the transmitter concurrently transmits the sensor data, the transmitter transmits the sensor data stored in the buffer memory to the external apparatus while giving priority to sensor data corresponding to the classification including a shorter delay time.

4. The vehicle-mounted device according to claim 3, wherein the buffer memory includes a plurality of buffers for respectively storing sensor data having delay times classified into the plurality of classifications, and capacities of the plurality of buffers are set such that a buffer corresponding to the classification including the shorter delay time has a smaller capacity.

5. The vehicle-mounted device according to claim 1, wherein the buffer memory is configured to:

start storing the sensor data when the circuitry determines that the predetermined condition is satisfied; and stop storing the sensor data when the determination result obtained by the circuitry changes to indicate that the predetermined condition is not satisfied after it has been determined that the predetermined condition is satisfied.

6. A server computer comprising:

a receiver that receives the sensor data concurrently transmitted from the vehicle-mounted device according to claim 1; and a processor that classifies the sensor data received by the receiver into a plurality of classifications in accordance with the delay times and executes data processing according to each of the plurality of classifications.

7. A system comprising:

a vehicle-mounted device installed in a vehicle; and a server computer that communicates with the vehicle-mounted device, wherein the vehicle-mounted device comprises circuitry configured to collect sensor data detected by a sensor with which the vehicle is equipped;

a transmitter configured to transmit the sensor data to an external apparatus;

buffer memory configured to store the sensor data, wherein the circuitry is configured to determine whether a predetermined condition is satisfied;

control transmission of the sensor data by the transmitter to the external apparatus;

cause the transmitter to stop transmitting the sensor data to the external apparatus when it is determined that the predetermined condition is satisfied; and cause, when a result of the determination changes to indicate that the predetermined condition is not satisfied after it has been determined that the predetermined condition is satisfied, the transmitter to concurrently transmit the sensor data stored in the buffer memory to the external apparatus while giving priority to sensor data with a shorter delay time based on priority levels according to delay times, the delay times each representing a difference between an acquisition time point of the sensor data and a current time point, wherein the predetermined condition includes a state where the vehicle is located within a predetermined range on a road map specified by area information received from the external apparatus and an occurrence of a phenomenon in which communication with the external apparatus is not possible, wherein if the predetermined condition includes the occurrence of the phenomenon, the circuitry is configured to determine that the predetermined condition is satisfied if the phenomenon has occurred, and determine that the predetermined condition is not satisfied if the phenomenon has not occurred; and a receiver configured to receive a plurality of permissible delay times from the external apparatus that performs a plurality of processes, each permissible delay time representing an upper limit for a difference between the acquisition time point of the sensor data to be processed and a time point for executing a corresponding process in the plurality of processes, wherein the buffer memory includes a plurality of buffers individually having capacities set for the plurality of permissible delay times for storing the sensor data to be processed in the plurality of processes, the receiver is configured to receive a transmission delay time and a processing delay time from the external apparatus, the transmission delay time being a time from when the sensor data corresponding to each permissible delay time is transmitted from the vehicle-mounted device to when the sensor data is received by the external apparatus, the processing delay time being a time spent from when the sensor data corresponding to each permissible delay time starts to undergo the process to when the sensor data has completely undergone the process, and the circuitry is configured to predict a line speed of a communication line when the transmitter concurrently transmits the sensor data; and change each of the capacities of the plurality of buffers to a value set in accordance with the predicted line speed, the permissible delay time, the transmission delay time, the processing delay time, and a throughput, the throughput being a processing rate from when sensor data corresponding to the respective permissible delay times is read from the plurality of buffers to when the sensor data is transmitted when the transmitter concurrently transmits the sensor data, and wherein the server computer comprises a receiver that receives the sensor data concurrently transmitted from the vehicle-mounted device, and a processor that classifies the sensor data received by the receiver into a plurality of classifications in accordance with the delay times and executes data processing according to each of the plurality of classifications.

* * * * *